US010278450B2

(12) United States Patent
Cin

(10) Patent No.: US 10,278,450 B2
(45) Date of Patent: May 7, 2019

(54) SOLE STRUCTURES AND ARTICLES OF FOOTWEAR HAVING AN ELONGATED HEXAGONAL SIPING PATTERN AND/OR A HEEL POCKET STRUCTURE

(71) Applicant: NIKE, Inc., Beaverton, OR (US)

(72) Inventor: David Jonathan Cin, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 133 days.

(21) Appl. No.: 14/877,434

(22) Filed: Oct. 7, 2015

(65) Prior Publication Data

US 2017/0099907 A1 Apr. 13, 2017

(51) Int. Cl.

| | |
|---|---|
| ***A43B 13/22*** | (2006.01) |
| ***A43B 23/02*** | (2006.01) |
| ***A43B 1/00*** | (2006.01) |
| ***A43B 13/26*** | (2006.01) |

(52) U.S. Cl.

CPC ..... *A43B 13/223* (2013.01); *A43B 1/0009* (2013.01); *A43B 13/26* (2013.01); *A43B 23/0205* (2013.01)

(58) Field of Classification Search

CPC ..... A43B 13/223; A43B 13/141; A43B 13/16; A43B 13/184; A43B 13/186; A43B 13/26

See application file for complete search history.

(56) References Cited

U.S. PATENT DOCUMENTS

| | | | | |
|---|---|---|---|---|
| 4,309,831 | A * | 1/1982 | Pritt | A43B 7/06 36/3 B |
| 4,897,936 | A * | 2/1990 | Fuerst | A43B 13/12 36/114 |
| 6,178,662 | B1 * | 1/2001 | Legatzke | A43B 1/0009 36/29 |
| D631,237 | S * | 1/2011 | Genuin | D2/951 |
| 7,941,938 | B2 | 5/2011 | Yu et al. | |
| D656,722 | S * | 4/2012 | Hall | D2/951 |
| 8,186,078 | B2 | 5/2012 | Avar et al. | |
| 8,321,984 | B2 | 12/2012 | Dojan et al. | |
| 8,375,604 | B2 * | 2/2013 | Eder | A43B 13/26 36/114 |
| 8,393,028 | B2 | 3/2013 | Kim et al. | |

(Continued)

OTHER PUBLICATIONS

Jan. 18, 2017—(WO) International Search Report and Written Opinion—App PCT/US2016/055517.

*Primary Examiner* — Jila M Mohandesi
(74) *Attorney, Agent, or Firm* — Banner & Witcoff, Ltd.

(57) ABSTRACT

Sole structures for articles of footwear include sipes that define discrete hexagonally-shaped sole elements at the ground-engaging or ground-facing surface. At least some of the arch-supporting hexagonally shaped sole elements may be elongated in one direction as compared to at least some of the corresponding hexagonally shaped sole elements in the heel and/or forefoot support areas. Additionally or alternatively, the sole structure may include a perimeter rim and/or side wall integrally formed with and extending upward from a foot-supporting surface at least at a rear heel area of the sole structure. This perimeter rim and/or side wall forms a rear heel pocket that engages at least a portion of the heel area of the upper (e.g., the rear heel area) with an interior surface of the perimeter rim and/or side wall.

26 Claims, 20 Drawing Sheets

(56) References Cited

U.S. PATENT DOCUMENTS

| | | | | |
|---|---|---|---|---|
| 8,429,835 | B2 | 4/2013 | Dojan et al. | |
| D689,677 | S * | 9/2013 | Bathum | D2/951 |
| 8,832,970 | B2 | 9/2014 | Avar et al. | |
| D744,735 | S * | 12/2015 | Wawrousek | D2/951 |
| 2002/0166258 | A1* | 11/2002 | Posa | A43B 3/10 36/3 A |
| 2008/0201992 | A1* | 8/2008 | Avar | A43B 1/0009 36/25 R |
| 2013/0192092 | A1 | 8/2013 | Eder et al. | |
| 2013/0198977 | A1 | 8/2013 | Kim et al. | |
| 2014/0352083 | A1 | 12/2014 | Avar et al. | |
| 2015/0128452 | A1 | 5/2015 | Hull et al. | |
| 2015/0223560 | A1* | 8/2015 | Wawrousek | A43B 13/00 36/25 R |
| 2015/0282564 | A1 | 10/2015 | Meschter et al. | |
| 2015/0282565 | A1 | 10/2015 | Kilgore | |

* cited by examiner

SOLE STRUCTURES AND ARTICLES OF FOOTWEAR HAVING AN ELONGATED HEXAGONAL SIPING PATTERN AND/OR A HEEL POCKET STRUCTURE

FIELD OF THE INVENTION

The present invention relates to sole structures for articles of footwear. Additional aspects of this invention relate to methods of making these sole structures, articles of footwear containing these sole structures, and/or methods of making such articles of footwear.

BACKGROUND

Conventional articles of athletic footwear include two primary elements, namely, an upper and a sole structure. The upper provides a covering for the foot that securely receives and positions the foot with respect to the sole structure. In addition, the upper may have a configuration that protects the foot and provides ventilation, thereby cooling the foot and removing perspiration. The sole structure is secured to a lower surface of the upper and generally is positioned between the foot and any contact surface. In addition to attenuating ground reaction forces and absorbing energy, the sole structure supports the foot and may provide traction and help control potentially harmful foot motion, such as over pronation. General features and configurations of the upper and sole structure are discussed in greater detail below.

The upper forms a void on the interior of the footwear for receiving the foot. The void has the general shape of the foot, and access to the void is provided at an ankle opening. Accordingly, the upper may extend over the instep and toe areas of the foot, along the medial and lateral sides of the foot, and around the heel area of the foot. A lacing system often is incorporated into the upper to allow selective changes to the size of the ankle opening and to permit the wearer to modify certain dimensions of the upper, particularly girth, to accommodate feet with varying proportions. In addition, the upper may include a tongue that extends under the lacing system to enhance the comfort of the footwear (e.g., to moderate pressure applied to the foot by the laces). The upper also may include a heel counter to limit or control movement of the heel.

The sole structure generally incorporates multiple layers that are conventionally referred to as an "insole," a "midsole," and an "outsole." The insole (which also may constitute a sock liner) is a thin member located within the upper and adjacent the plantar (lower) surface of the foot to enhance footwear comfort, e.g., to wick away moisture and provide a soft, comfortable feel. The midsole, which is traditionally attached to the upper along the entire length of the upper, forms the middle layer of the sole structure and serves a variety of purposes that include controlling foot motions and attenuating impact forces. The outsole forms the ground-contacting element of footwear and is usually fashioned from a durable, wear-resistant material that includes texturing or other features to improve traction.

TERMINOLOGY/GENERAL INFORMATION

First, some general terminology and information is provided that will assist in understanding various portions of this specification and the invention(s) as described herein. As noted above, the present invention relates to the field of footwear. "Footwear" means any type of wearing apparel for the feet, and this term includes, but is not limited to: all types of shoes, boots, sneakers, sandals, thongs, flip-flops, mules, scuffs, slippers, sport-specific shoes (such as track shoes, golf shoes, tennis shoes, baseball cleats, soccer or football cleats, ski boots, basketball shoes, cross training shoes, etc.), and the like.

FIG. 1A provides information that may be useful for explaining and understanding the specification and/or aspects of this invention. More specifically, FIG. 1A provides a representation of a footwear component 100, which in this illustrated example constitutes a portion of a sole structure for an article of footwear. The same general definitions and terminology described below may apply to footwear in general and/or to other footwear components or portions thereof, such as an upper, a sole structure, a midsole component, an outsole component, a ground-engaging component, etc.

First, as illustrated in FIG. 1A, the terms "forward" or "forward direction" as used herein, unless otherwise noted or clear from the context, mean toward or in a direction toward a forward-most toe ("FT") area of the footwear structure or component 100. The terms "rearward" or "rearward direction" as used herein, unless otherwise noted or clear from the context, mean toward or in a direction toward a rear-most heel area ("RH") of the footwear structure or component 100. The terms "lateral" or "lateral side" as used herein, unless otherwise noted or clear from the context, mean the outside or "little toe" side of the footwear structure or component 100. The terms "medial" or "medial side" as used herein, unless otherwise noted or clear from the context, mean the inside or "big toe" side of the footwear structure or component 100.

Also, various example features and aspects of this invention may be disclosed or explained herein with reference to a "longitudinal direction" and/or with respect to a "longitudinal length" of a footwear component 100 (such as a footwear sole structure). As shown in FIG. 1A, the "longitudinal direction" is determined as the direction of a line extending from a rearmost heel location (RH in FIG. 1A) to the forwardmost toe location (FT in FIG. 1A) of the footwear component 100 in question (a sole structure or foot-supporting member in this illustrated example). The "longitudinal length" L is the length dimension measured from the rearmost heel location RH to the forwardmost toe location FT. The rearmost heel location RH and the forwardmost toe location FT may be located by determining the rear heel and forward toe tangent points with respect to back and front parallel vertical planes VP when the component 100 (e.g., sole structure or foot-supporting member in this illustrated example, optionally included as part of an article of footwear or foot-receiving device) is oriented on a horizontal support surface S in an unloaded condition (e.g., with no weight applied to it other than potentially the weight of the shoe components with which it is engaged). If the forwardmost and/or rearmost locations of a specific footwear component 100 constitute a line segment (rather than a tangent point), then the forwardmost toe location and/or the rearmost heel location constitute the mid-point of the corresponding line segment. If the forwardmost and/or rearmost locations of a specific footwear component 100 constitute two or more separated points or line segments, then the forwardmost toe location and/or the rearmost heel location constitute the mid-point of a line segment connecting the furthest spaced and separated points and/or furthest spaced and separated end points of the line segments (irrespective of whether the midpoint itself lies on the component 100 structure). If the forwardmost and/or rearwardmost locations constitute one or more areas, then the forwardmost toe location and/or the rearwardmost heel location constitute the geographic center of the area or combined areas (irrespective of whether the geographic center itself lies on the component 100 structure).

Once the longitudinal direction of a component or structure 100 has been determined with the component 100 oriented on a horizontal support surface S, planes may be oriented perpendicular to this longitudinal direction (e.g., planes running into and out of the page of FIG. 1A). The locations of these perpendicular planes may be specified based on their positions along the longitudinal length L where the perpendicular plane intersects the longitudinal direction between the rearmost heel location RH and the forwardmost toe location FT. In this illustrated example of FIG. 1A, the rearmost heel location RH is considered as the origin for measurements (or the "0L position") and the forwardmost toe location FT is considered the end of the longitudinal length L of this component 100 (or the "1.0L position"). Plane position may be specified based on its location along the longitudinal length L (between 0L and 1.0L), measured forward from the rearmost heel RH location in this example. FIG. 1A further shows locations of various planes perpendicular to the longitudinal direction (and oriented in the transverse direction) and located along the longitudinal length L at positions 0.25L, 0.4L, 0.5L, 0.55L, 0.6L, and 0.8L (measured in a forward direction from the rearmost heel location RH). These planes may extend into and out of the page of the paper from the view shown in FIG. 1A, and similar planes may be oriented at any other desired positions along the longitudinal length L. While these planes may be parallel to the parallel vertical planes VP used to determine the rearmost heel RH and forwardmost toe FT locations, this is not a requirement. Rather, the orientations of the perpendicular planes along the longitudinal length L will depend on the orientation of the longitudinal direction, which may or may not be parallel to the horizontal surface S in the arrangement/orientation shown in FIG. 1A.

Additional aspects of this invention relate to hexagonal features of various footwear components, such as sipe configurations, footwear sole elements, and the like. The terms "hexagon" and "hexagonal" as used herein mean any six-sided polygon structure or shape, including six-sided polygon structures having sides of the same or different dimensions or lengths and the same or different sized angles between adjacent sides. Some examples of "hexagons" are shown in FIGS. 1B-1D. In the example of FIG. 1B, the "hexagon" has six equal side lengths forming six corners or vertices having the same angle. The example "hexagon" of FIG. 1C has four longer sides of one size and two shorter sides of a different (smaller) size. Thus, this "hexagon" forms two larger angles between adjacent sides and four smaller angles between other adjacent sides. Other "hexagons" may have other arrangements and/or combinations of side lengths and/or angular features, e.g., such as the irregular hexagon shown in FIG. 1D. Also, the terms "hexagon" and "hexagonal" as used herein include shapes and/or structures having side edges joined at rounded corners (rather than the more pronounced and "sharp" corners shown in FIGS. 1B and 1C) provided that the six-sided configuration remains apparent (e.g., relatively straight side edges joined by a rounded corner).

FIGS. 1B-1D further show that "hexagon" structures include opposite sides or surfaces (i.e., the sides or surfaces that are separated by two sets of two other adjacent sides or surfaces of the hexagon). More specifically, as shown in FIGS. 1B-1D, the sides or surfaces labeled "A" are "opposite" one another (as are the sides or surfaces labeled "B" and the sides or surfaces labeled "C"). Likewise, "hexagon" structures include opposite vertices or corners (i.e., the vertices or corners that are separated by two sets of two other adjacent vertices or corners of the hexagon). As shown in FIGS. 1B-1D, the "opposite" "vertices" or "corners" of the "hexagons" are connected by diagonal lines (also called "diagonals" herein) labeled D1, D2, D3, D4, D5, D6, D7, D8, D9, D10, D11, and D12. The physical length of an individual diagonal line is referred to herein as a "diagonal dimension." Each "hexagon" includes three diagonal lines, and the diagonal lines of an individual "hexagon" as that term is used herein may have the same or different diagonal dimensions.

A hexagon may be described herein as being "elongated" if at least one of its diagonal dimensions is at least 5% longer than at least one other diagonal dimension. In some examples, an elongated hexagon will have a diagonal line (e.g., D4 in FIG. 1C) that is from 10% to 85% as long as another diagonal line (e.g., D5 and/or D6 of FIG. 1C), and in some examples, from 15% to 80% as long, from 20% to 70% as long, or even from 25% to 60% as long as another diagonal line. FIG. 1B illustrates a regular hexagon structure that may be used in footwear structures in accordance with some examples of this invention, and FIG. 1C illustrates a hexagon structure that is elongated in the direction between opposite sides C that may be used in footwear structures in accordance with some examples of this invention.

BRIEF DESCRIPTION OF THE DRAWINGS

The present invention is illustrated by way of example and not limited in the accompanying figures, in which like reference numerals indicate the same or similar elements throughout, and in which.

Figure 1A:
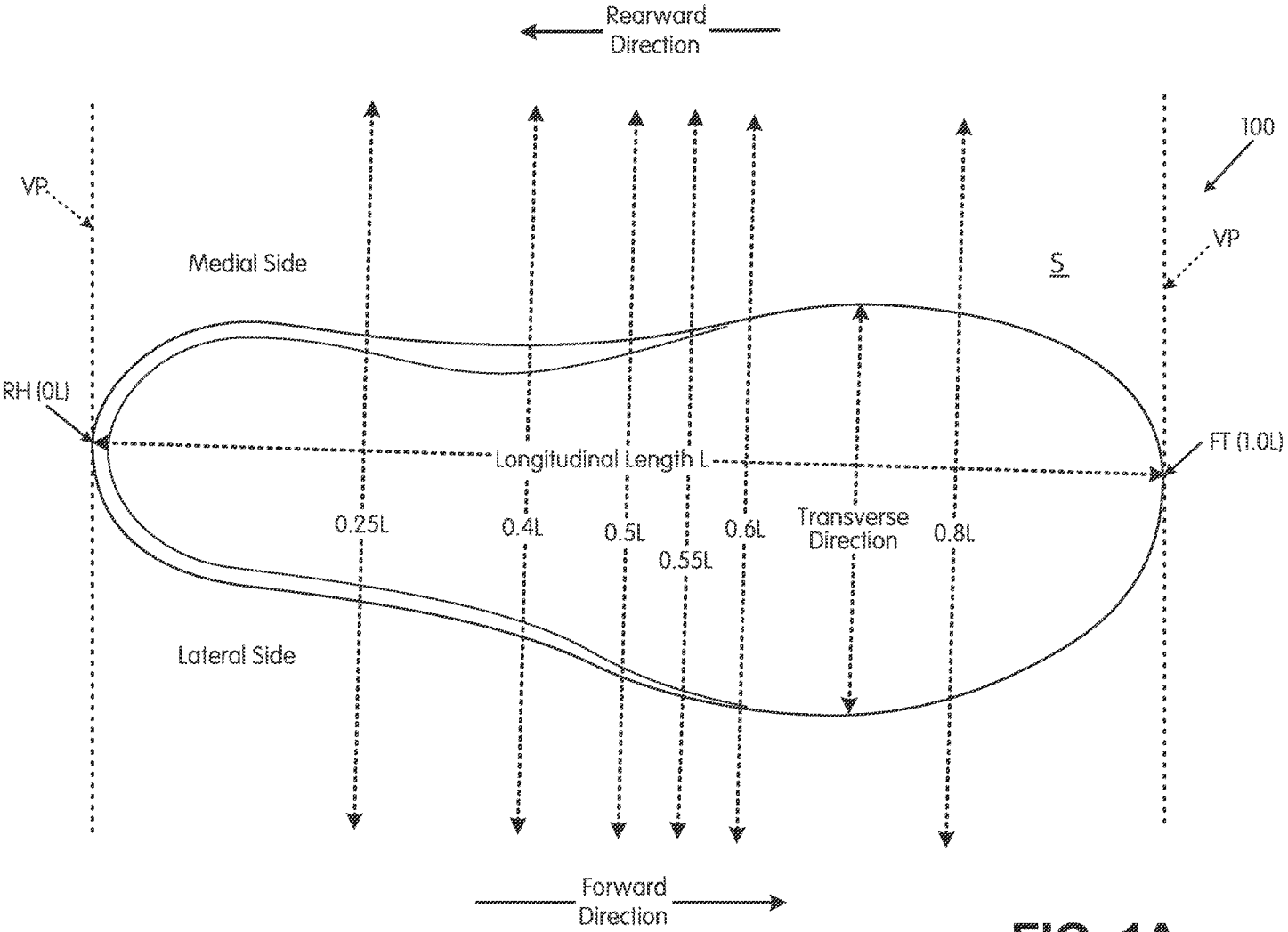
FIGS. 1A-1D are views provided to help illustrate and explain background and definitional information useful for understanding certain terminology and aspects of this invention.
Figure 1B:
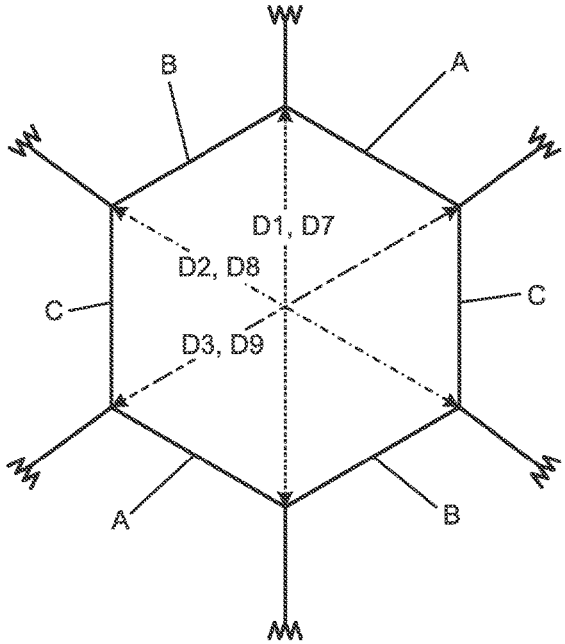
Figure 1D:
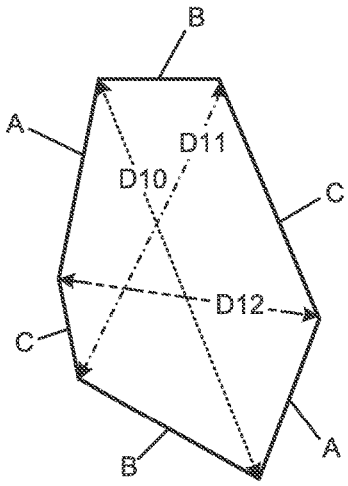

The reader is advised that the various parts shown in these drawings are not necessarily drawn to scale.

DETAILED DESCRIPTION

The following description and the accompanying figures describe various example features of footwear components, articles of footwear, and methods in accordance with aspects of the present invention. When the same reference number appears in more than one drawing, that reference number is used consistently in this specification and the drawings to refer to the same or similar parts or elements throughout.

The following paragraphs generally describe detailed features of various aspects of the invention followed by some specific examples of structures and methods according to this invention.

I. General Description of Various Aspects of this Invention a. Footwear Components and Methods of Making Them Some aspects of this invention relate to sole structures for articles of footwear that include: (a) a foot-supporting surface extending longitudinally along a length of the sole structure and transversely between a medial side and a lateral side of the sole structure; (b) a ground-engaging or ground-facing surface opposite the foot-supporting surface, wherein the ground-engaging or ground-facing surface extends longitudinally along the length of the sole structure and transversely between the medial side and the lateral side of the sole structure; (c) a volume of sole material between the foot-supporting surface and the ground-engaging or ground-facing surface to thereby define a thickness profile of the sole structure between the foot-supporting surface and the ground-engaging or ground-facing surface; and (d) a plurality of sipes extending from the ground-engaging or ground-facing surface into the volume of sole material. At least some of the plurality of sipes form a hexagonal pattern and define a plurality of discrete hexagonally-shaped sole elements at the ground-engaging or ground-facing surface, wherein individual hexagonally-shaped sole elements are at least partially defined by one or more sipes of the plurality of sipes, and wherein the plurality of discrete hexagonally-shaped sole elements includes: (i) a plurality of heel-supporting hexagonally-shaped sole elements including at least a first heel-supporting hexagonally-shaped sole element and a second heel-supporting hexagonally-shaped sole element, (ii) a plurality of forefoot-supporting hexagonally-shaped sole elements including at least a first forefoot-supporting hexagonally-shaped sole element and a second forefoot-supporting hexagonally-shaped sole element, and (iii) a plurality of arch-supporting hexagonally-shaped sole elements including at least a first arch-supporting hexagonally-shaped sole element and a second arch-supporting hexagonally-shaped sole element. Each of the first arch-supporting hexagonally shaped sole element and the second arch-supporting hexagonally-shaped sole element of this example has a longer length dimension in a direction of the length of the sole structure (e.g., in the longitudinal direction) than corresponding length dimensions of the first heel-supporting hexagonally-shaped sole element, the second heel-supporting hexagonally-shaped sole element, the first forefoot-supporting hexagonally-shaped sole element, and the second forefoot-supporting hexagonally-shaped sole element in the direction of the length (e.g., in the longitudinal direction) of the sole structure. Also, if desired, each of the first and second arch-supporting hexagonally shaped sole elements, the first and second heel-supporting hexagonally-shaped sole elements, and the first and second forefoot-supporting hexagonally-shaped sole elements may have a diagonal oriented in a medial side-to-lateral side direction of the sole structure (and optionally, oriented parallel to the transverse direction of the sole structure or within 10° of parallel to the transverse direction of the sole structure).

Sole structures for articles of footwear in accordance with some examples of this invention may include: (a) a foot-supporting surface extending longitudinally along a length of the sole structure and transversely between a medial side and a lateral side of the sole structure; (b) a ground-engaging or ground-facing surface opposite the foot-supporting surface, wherein the ground-engaging or ground-facing surface extends longitudinally along the length of the sole structure and transversely between the medial side and the lateral side of the sole structure; (c) a volume of sole material between the foot-supporting surface and the ground-engaging or ground-facing surface to thereby define a thickness profile of the sole structure between the foot-supporting surface and the ground-engaging or ground-facing surface; and (d) a plurality of sipes extending from the ground-engaging or ground-facing surface into the volume of sole material, wherein at least some of the plurality of sipes form a hexagonal pattern and define a plurality of discrete hexagonally-shaped sole elements at the ground-engaging or ground-facing surface, and wherein individual hexagonally-shaped sole elements are at least partially defined by one or more sipes of the plurality of sipes. The plurality of discrete hexagonally-shaped sole elements of this example (and the other examples described above) may include:

(a) a plurality of heel-supporting hexagonally-shaped sole elements defining a first diagonal, a first diagonal dimension D1, a second diagonal, a second diagonal dimension D2, a third diagonal, and a third diagonal dimension D3, and wherein at least two heel-supporting hexagonally-shaped sole elements (and optionally a majority of the heel-supporting hexagonally shaped sole elements) of the plurality of heel-supporting hexagonally-shaped sole elements include the following properties:
D1=0.8 D2 to 1.2 D2; D1=0.8 D3 to 1.2 D3; and D2=0.8 D3 to 1.2 D3, (b) a plurality of arch-supporting hexagonally-shaped sole elements defining a fourth diagonal, a fourth diagonal dimension D4, a fifth diagonal, a fifth diagonal dimension D5, a sixth diagonal, and a sixth diagonal dimension D6, and wherein at least two arch-supporting hexagonally-shaped sole elements (and optionally a majority of the arch-supporting hexagonally shaped sole elements) of the plurality of arch-supporting hexagonally-shaped sole elements include the following properties:
D4=0.25 D5 to 0.6 D5; D4=0.25 D6 to 0.6 D6; and D5=0.8 D6 to 1.2 D6; and (c) a plurality of forefoot-supporting hexagonally-shaped sole elements, defining a seventh diagonal, a seventh diagonal dimension D7, an eighth diagonal, an eighth diagonal dimension D8, a ninth diagonal, and a ninth diagonal dimension D9, and wherein at least two forefoot-supporting hexagonally-shaped sole elements (and optionally a majority of the forefoot-supporting hexagonally shaped sole elements) of the plurality of forefoot-supporting hexagonally-shaped sole elements include the following properties:
D7=0.8 D8 to 1.2 D8; D7=0.8 D9 to 1.2 D9, and D8=0.8 D9 to 1.2 D9.

Sole structures in accordance with at least some examples of this invention further may include any one or more of the following features and/or properties:

D1=0.9 D2 to 1.1 D2, D1=0.9 D3 to 1.1 D3,
D2=0.9 D3 to 1.1 D3 D4=0.3 D5 to 0.5 D5,
D4=0.3 D6 to 0.5 D6, D5=0.9 D6 to 1.1 D6,
D7=0.9 D8 to 1.1 D8, D7=0.9 D9 to 1.1 D9,
D8=0.9 D9 to 1.1 D9, D4=0.6 D1 to 1.1 D1,
D4=0.6 D7 to 1.1 D7, D5=1.5 D2 to 2.5 D2,
D5=1.5 D8 to 2.5 D8, D6=1.5 D3 to 2.5 D3,
D5=1.5 D9 to 2.5 D9, D1=D2=D3,
D2=D3, D1=D3
D1=D2, D7=D8=D9,
D7=D8, D7=D9,
D8=D9, and D5=D6.

In these example sole structures, the first diagonal, the fourth diagonal, and the seventh diagonal may be oriented to extend in a medial side-to-lateral side direction of the sole structure. Additionally or alternatively, if desired, each of D1, D2, D3, D4, D5, D6, D7, D8, and D9 may be less than 25 mm; each of D1, D2, D3, D4, D7, D8, and D9 may be less than 12 mm or even less than 10 mm; and/or each of D5 and D6 may be greater than 12 mm, or even greater than 15 mm.

Sole structures in accordance with at least some examples of this invention (including any of the specific examples described above) further may include a plurality of sipes extending from the foot-supporting surface into the volume of sole material in a forefoot area and/or in a heel area of the foot-supporting surface. If desired, at least some of this plurality of sipes extending from the foot-supporting surface may form a hexagonal pattern. The hexagonal siping pattern(s) on the foot-supporting surface, when present, may align vertically with or may be vertically offset from the hexagonal patterns provided on the ground-engaging or ground-facing surface (when the sole structure is oriented on a horizontal support surface). If desired, an unsiped thickness of the sole material may be provided between and vertically separate the plurality of sipes extending from the ground-engaging or ground-facing surface in the forefoot area and/or the heel area of the ground-supporting surface and the plurality of sipes extending from the foot-supporting surface in the forefoot area and/or the heel area of the foot-supporting surface. In the forefoot area, at least some portion of the unsiped thickness (when present) may be at least 2 mm thick (and in some examples, at least 4 mm, at least 6 mm, at least 8 mm, or even at least 10 mm thick). In the heel area, at least some portion of the unsiped thickness (when present) may be at least 8 mm thick (and in some examples, at least 10 mm, at least 12 mm, at least 14 mm, or even at least 16 mm thick).

As an additional potential feature, sole structures in accordance with at least some examples of this invention (including any examples described above) further may include a perimeter rim and/or perimeter side wall extending upward from the foot-supporting surface at least at a rear heel area of the sole structure. The perimeter rim and/or perimeter side wall may define and form a rear heel pocket. The rear heel pocket (e.g., its interior surface) can engage the footwear upper (e.g., its exterior side surface) and provide additional support and/or shape for the heel area of the shoe (e g, akin to a heel counter type structure).

Sole structures in accordance with still some additional aspects of this invention may include: (a) a foot-supporting surface extending longitudinally along a length of the sole structure and transversely between a medial side and a lateral side of the sole structure; (b) a ground-engaging or ground-facing surface opposite the foot-supporting surface, wherein the ground-engaging or ground-facing surface extends longitudinally along the length of the sole structure and transversely between the medial side and the lateral side of the sole structure; (c) a volume of sole material between the foot-supporting surface and the ground-engaging or ground-facing surface to thereby define a thickness profile of the sole structure between the foot-supporting surface and the ground-engaging or ground-facing surface; and (d) a perimeter rim and/or perimeter side wall of the sole material integrally formed with and extending upward from the foot-supporting surface at least at a rear heel area of the sole structure.

This example perimeter rim and/or perimeter side wall of the sole material may define a rear heel pocket that extends partially over the foot-support surface at the rear heel area of the sole structure (e.g., forming a heel cup type structure). If desired, the perimeter rim and/or perimeter side wall may define a free edge extending at least 1 inch in a perimeter direction around the sole structure (and in some examples, extending at least 1.5 inches, at least 2 inches, or even at least 3 inches in the perimeter direction). This free edge may be at least 0.25 inch tall in a height direction (and in some examples, at least 0.5 inches or even at least 0.75 inches tall). This free edge of the perimeter rim and/or perimeter side wall may be no more than 0.25 inch thick (and in some examples, no more than 0.2 inch or even 0.15 inch thick) within the noted height dimension.

This example sole structure further may include a plurality of sipes extending from the ground-engaging or ground-facing surface into the volume of sole material, wherein at least some of the plurality of sipes form a hexagonal pattern and define a plurality of discrete hexagonally-shaped sole elements at the ground-engaging or ground-facing surface. Further, if desired, at least some of the plurality of sipes may form a plurality of elongated hexagonally-shaped sole elements, such as a plurality of elongated hexagonally-shaped sole elements formed in an arch support area of the ground-engaging or ground-facing surface. These elongated hexagonally-shaped sole elements may be oriented such that a long or longest opposite side-to-opposite side dimension extends in a longitudinal or front-to-back direction of the sole structure. As a more specific example, if desired, at least some of the plurality of elongated hexagonally-shaped sole elements may have: (a) a first pair of opposite sides (e.g., sides C in FIG. 1C), (b) a second pair of opposite sides (e.g., sides B in FIG. 1C), and (c) a third pair of opposite sides (e.g., sides A in FIG. 1C), wherein the first pair of opposite sides are spaced apart by a greater distance than a first spacing distance between the second pair of opposite sides and a second spacing distance between the third pair of opposite sides. As some more specific examples, the longest opposite side-to-opposite side dimension may be 1.1 to 2.5 times greater than the other opposite side-to-opposite side dimensions (e.g., in FIG. 1C, D13=1.1 D14 to 2.5 D14 and/or D13=1.1 D15 to 2.5 D15). If desired, such sole elements may be arranged such that center points of the first pair of opposite sides are spaced apart in a direction parallel to a longitudinal direction of the sole structure or within 10° of parallel to the longitudinal direction of the sole structure.

Additional aspects of this invention relate to articles of footwear that include any of the sole structures and/or sole structure options or features described above. Such articles of footwear may include an upper engaged (directly or indirectly) with any of the sole structures described above. Such uppers may at least partially define a foot-receiving chamber, including, optionally, defining an enclosed rear heel portion and/or an enclosed foot-receiving chamber (e.g., including only a single foot-insertion opening). For sole structures that include a perimeter rim and/or perimeter side wall (e.g., of the types described above), at least a portion of the enclosed rear heel portion of the upper may be engaged with an interior surface of the perimeter rim and/or perimeter side wall (and the perimeter rim and/or perimeter side wall may provide additional support, e.g., at the heel area, optionally functioning akin to a heel counter type structure).

The upper may take on any desired construction. In some examples, the upper will be formed to include a knitted upper component, such as a circular knitted component, a flat knitted component, etc. As some even more specific examples, the upper may include an upper base member: (a) formed as a single structure that defines the foot-receiving chamber, wherein the foot-receiving chamber has a single opening (i.e., a foot-insertion opening) and/or (b) formed as a sock or a sock-type structure. One or more support components may be engaged with the upper base member, such as one or more instep components having structures for engaging a shoe lace (e.g., on each of the lateral side and medial side), one or more toe cap members, one or more heel counter members, etc.

Additional aspects of this invention relate to methods of forming sole structures and/or articles of footwear of the types described above. As some more specific examples, the sole structures may be formed, for example, by molding a polymeric foam material into a desired shape for the sole structure (e.g., by injection molding, compression molding, etc.) and then forming the plurality of hexagonally shaped sipes therein (e.g., by laser cutting, hot knife cutting, etc.). Additionally or alternatively, at least some (or optionally all) sipes may be formed in the sole material during a molding process. The uppers may be formed, for example, at least in part by knitting processes, including circular knitting to form sock or sock-like upper base components. Support members may be engaged with the sock or sock-like upper base components, e.g., by one or more of hot melt adhesives, fusing techniques, stitching or sewing, mechanical connectors, etc. Alternatively, uppers and/or upper components may be formed in other manners as well, such as by sewing together various upper pieces, by molding techniques, etc. The uppers may be engaged with the sole structures, e.g., by one or more of cements or adhesives, mechanical connectors, etc.

Given the above general description of potential aspects and features of this invention, specific examples of structures, features, and methods according to aspects of this invention are described in more detail below in conjunction with FIGS. 1A-3I.

II. Detailed Description of Examples of this Invention

Figure 2A:
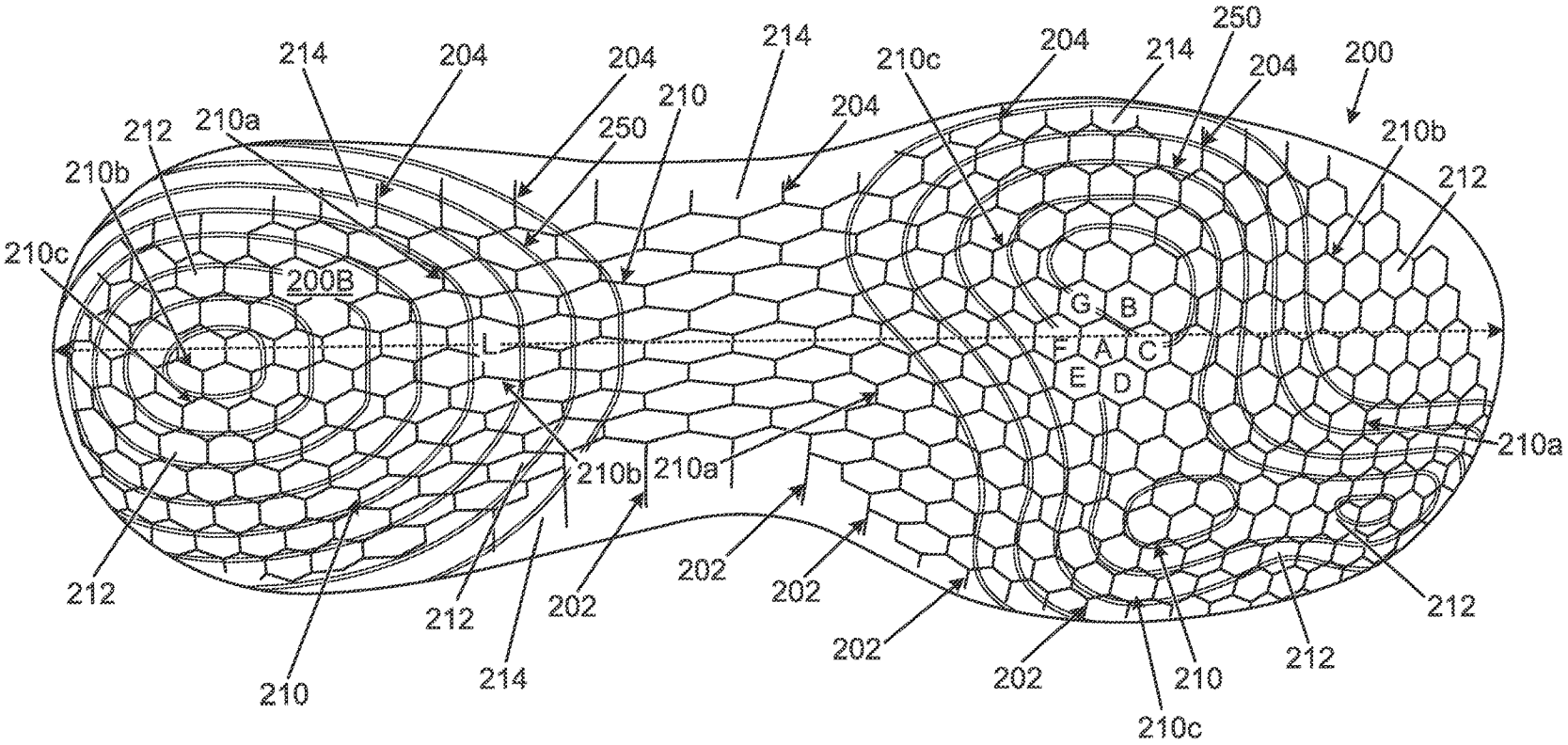
FIGS. 2A-2J provide various views of a sole structure in accordance with at least some examples of this invention.
Figure 2B:
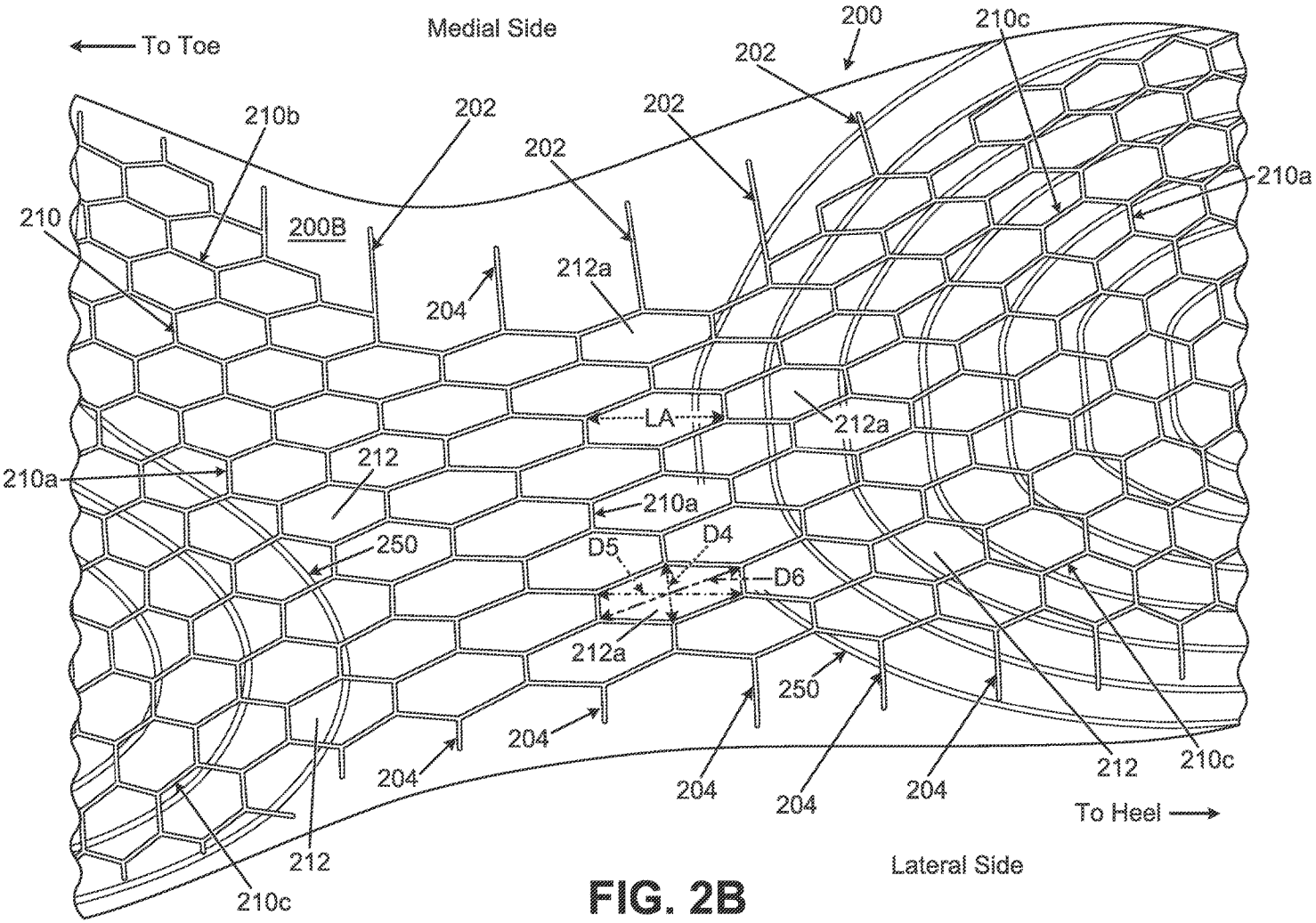
Figure 2C:
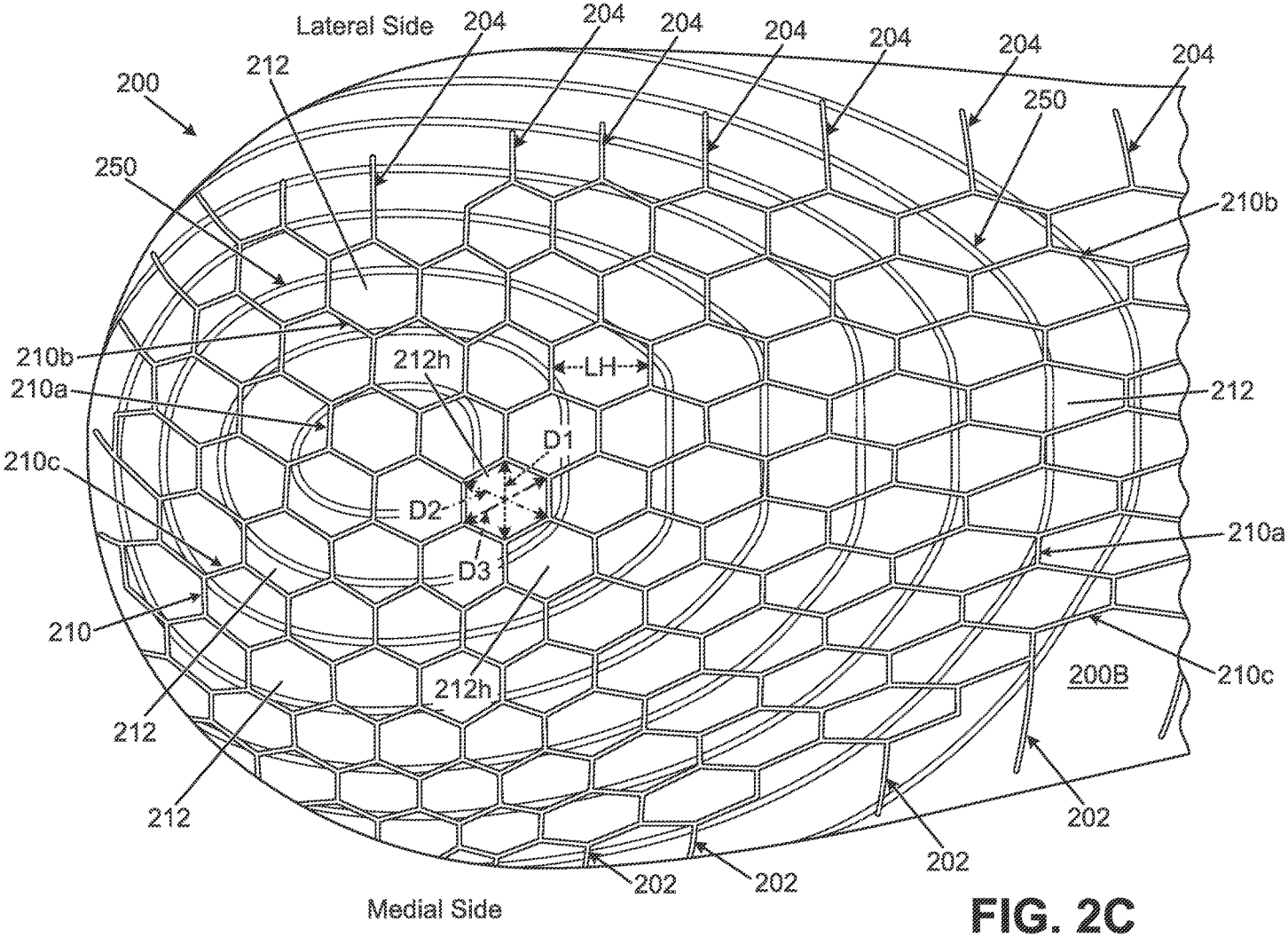
Figure 2D:
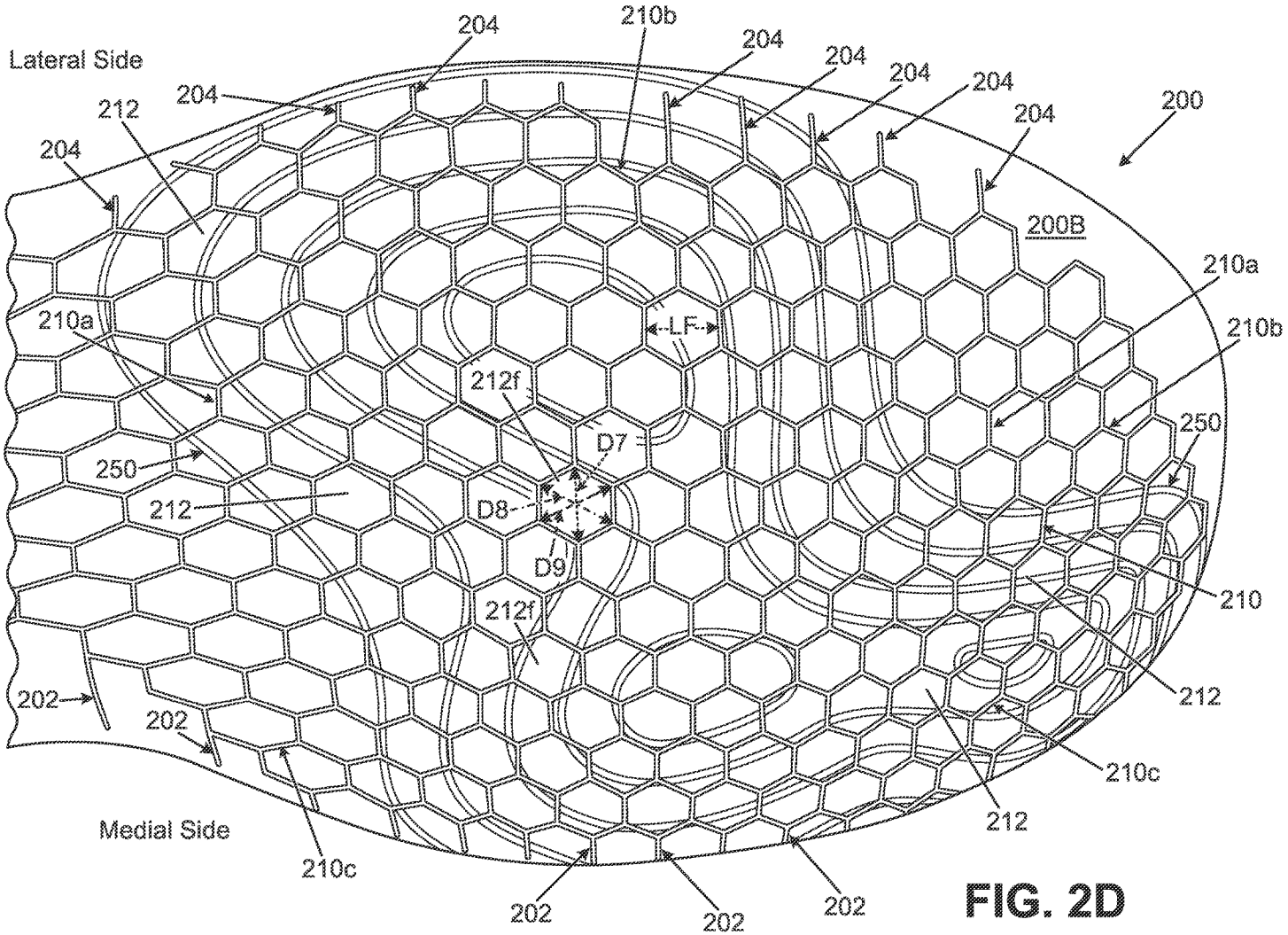
Figure 2E:
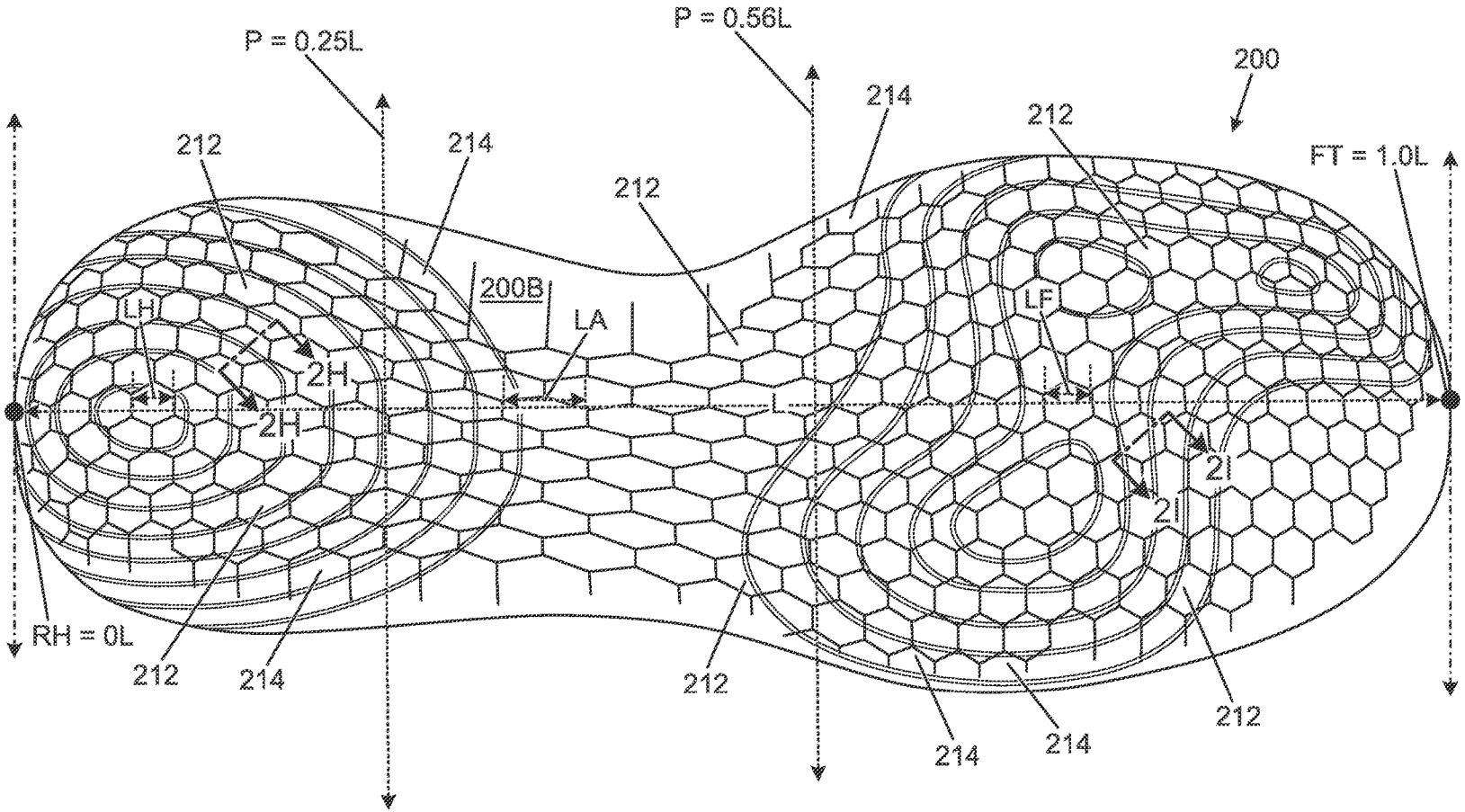
Figure 2F:
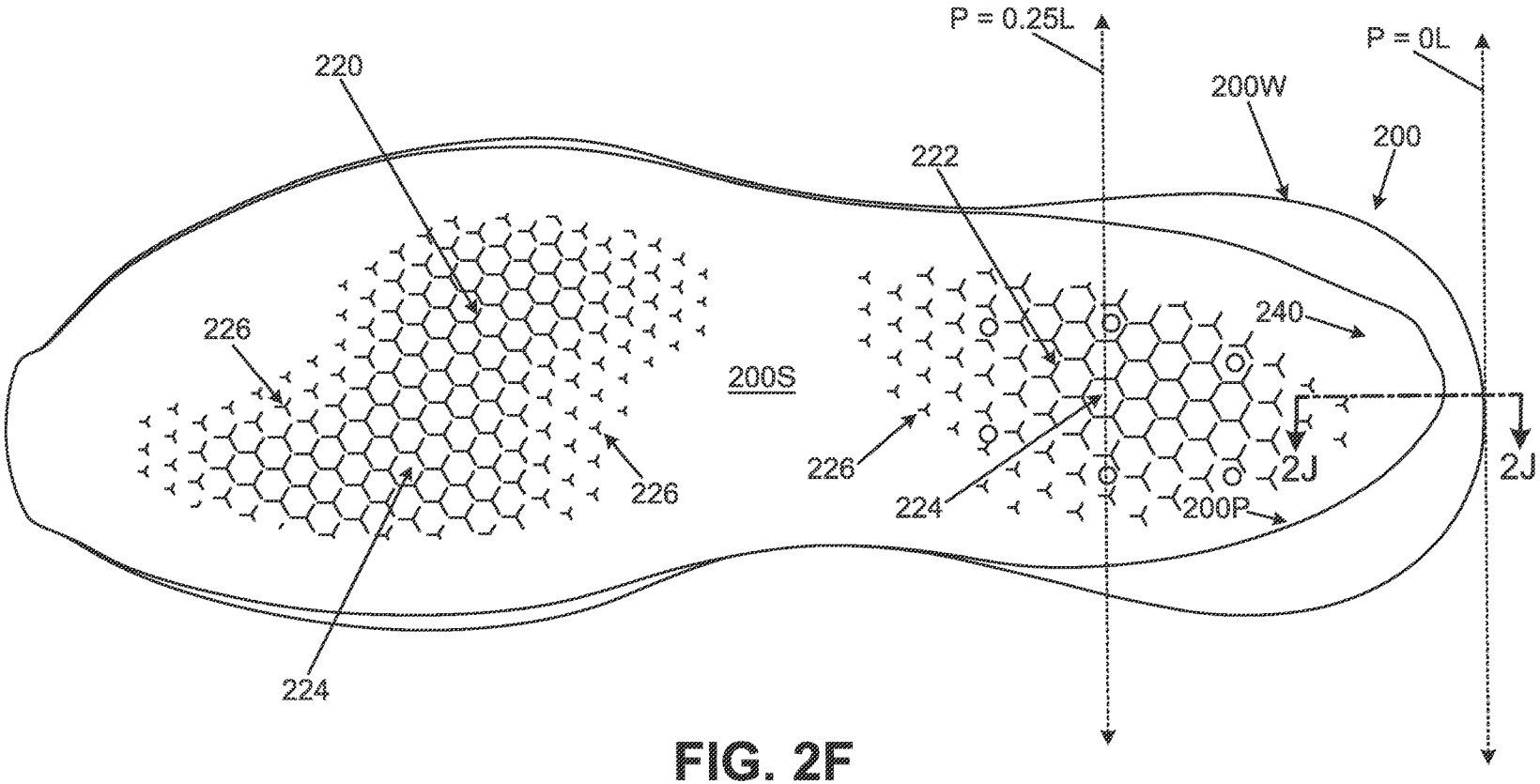
Figure 2G:
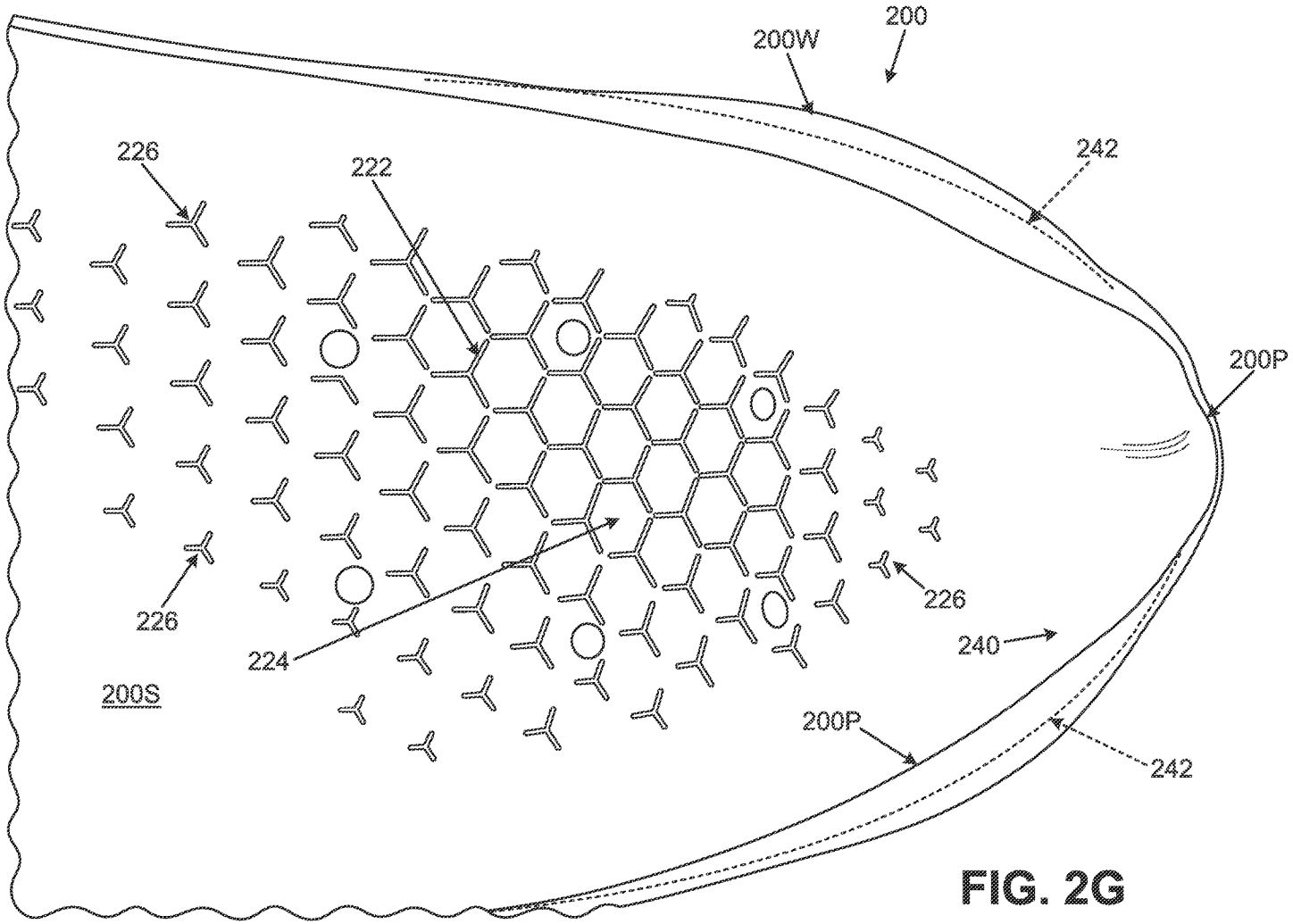
Figure 2H:
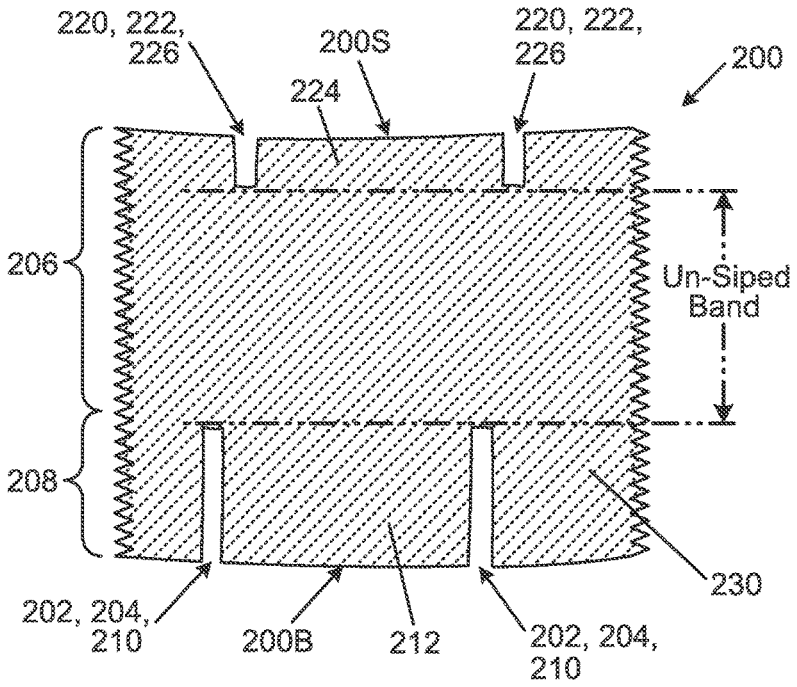
Figure 2I:
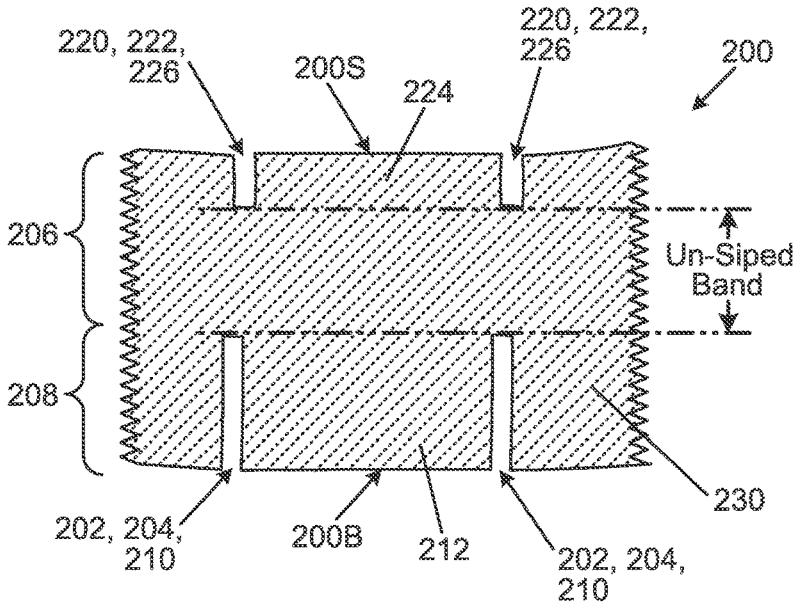
Figure 2J:
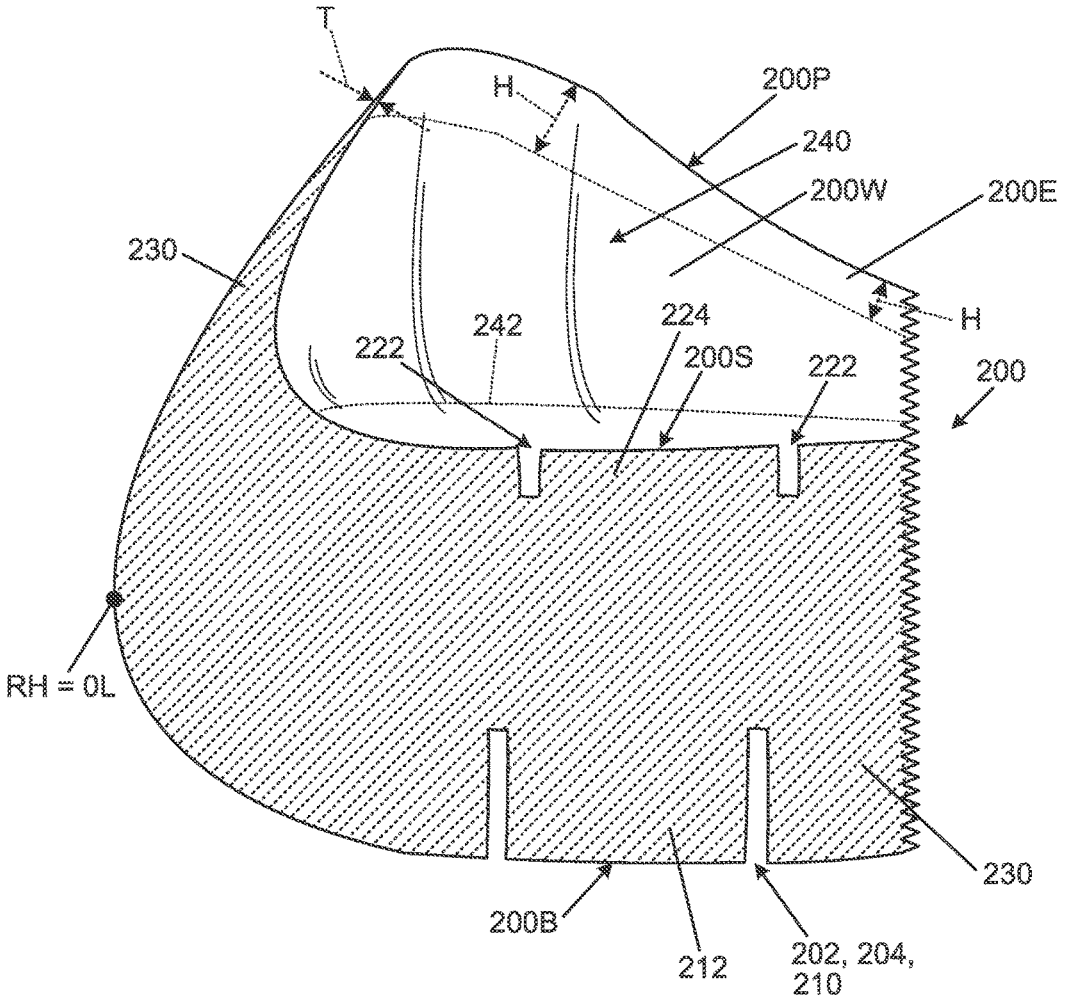

FIGS. 2A-2J provide various views of footwear sole structures 200 in accordance with some examples of this invention. More specifically, FIG. 2A is a bottom plan view of a footwear sole structure 200; FIG. 2B is an enlarged bottom plan view showing the arch support area of footwear sole structure 200; FIG. 2C is an enlarged bottom plan view showing the heel support area of footwear sole structure 200; FIG. 2D is an enlarged bottom plan view showing the forefoot support area of footwear sole structure 200; FIG. 2E is similar to FIG. 2A but provided to illustrate additional example features of this footwear sole structure 200; FIG. 2F is a top plan view of footwear sole structure 200; FIG. 2G is an enlarged top plan view showing the heel support area of footwear sole structure 200; FIG. 2H is a partial cross sectional view at a heel support area of footwear sole structure 200 (e.g., at the area generally shown in FIG. 2E); FIG. 2I is a partial cross sectional view at a forefoot support area of footwear sole structure 200 (e.g., at the area generally shown in FIG. 2E); and FIG. 2J is a partial cross sectional view at a heel support area of the footwear sole structure 200 (e.g., at the area generally shown in FIG. 2F).

While other constructions are possible, in this illustrated example, the sole structure 200 constitutes a single, one piece structure, e.g., made from a polymeric foam material. The material of the sole structure 200 may include any of various polymer materials (e.g., foams) utilized in footwear sole structures, including but not limited to polyurethane foams, thermoplastic polyurethanes (TPUs), or ethylvinylacetate (EVA) foams. The sole structure 200 also may be formed from relatively lightweight polyurethane foams having a specific gravity of approximately 0.22, as manufactured by Bayer AG under the BAYFLEX trademark and/or foam materials marketed under NIKE's LUNARLON trademarks. As yet some additional examples, the material of the sole structure 200 in accordance with some examples of this invention may be at least partially made from a foam material having a density of less than 0.25 g/cm$^3$ (and in some examples, a density of less than 0.2 g/cm$^3$, within the range of 0.075 to 0.2 g/cm$^3$, and even within the range of 0.1 to 0.18 g/cm$^3$). If desired, the foam material may include one or more openings defined therein and/or another impact-force attenuating component included with it, such as a fluid-filled bladder. As some additional examples, at least some of the sole structure 200 may be made from a foam material as described, for example, in U.S. Pat. No. 7,941,938, which patent is entirely incorporated herein by reference. The sole structure 200 may attenuate ground reaction forces and absorb energy when a wearer of a shoe including the sole structure 200 walks, runs, or performs other types of movements or activities.

The single piece sole structure 200 of this example extends to support an entire plantar surface of a wearer's foot (e.g., on footbed 200S, see FIG. 2F), from a heel area to a toe area and from a medial side edge to a lateral side edge. Alternatively, if desired, the sole structure 200 and/or at least a footbed portion 200S thereof may be made from multiple, separated parts and/or areas and/or it may extend to cover less than the entire plantar surface of a wearer's foot.

Additionally or alternatively, if desired, the sole structure 200 shown in FIGS. 2A-2J may be used as a "midsole" construction that optionally may be protected at one or more areas by an outsole structure. As some more specific examples, if desired, one or more outsole elements may be engaged with the bottom surface(s) of one or more of the individual hexagonally shaped sole elements defined by the sipes. Such outsole elements, when present, may be made of a wear resistant material, such as rubbers, thermoplastic polyurethanes, leathers, and/or other materials (including materials conventionally known and used in the outsole art), and they may provide additional traction, strength, wear resistance, abrasion resistance, and/or hardness at one or more targeted areas of the sole structure 200 that may need such features and/or properties. It will be appreciated with the benefit of this disclosure, however, that at least a portion of the bottom surface 200B of the sole structure 200 (and the sipes formed in the bottom surface) may be exposed in the final footwear product and/or may come into contact with the ground as a user walks, runs, or performs other types of movements. As some more specific examples, at least 40% of an exposed bottom surface area in a final shoe structure may constitute the bottom surface 200B of the sole structure 200 illustrated in FIGS. 2A-2J. In some examples, at least 60%, at least 80%, at least 90%, or even 100% of the exposed bottom surface area of final shoe structure will constitute the bottom surface 200B of the sole structure 200 illustrated in FIGS. 2A-2J.

The sole structure 200 of this illustrated example has an articulated construction that imparts relatively high flexibility and articulation. The flexible structure of the sole structure 200 is configured to complement the natural motion of the foot during walking, running or other movements, and it may impart a feeling or sensation of being barefoot. In contrast with being barefoot, however, the sole structure 200 attenuates ground reaction forces and absorbs energy to provide comfort and decrease the overall stress upon the foot. Furthermore, the sole structure 200 includes a plurality of sipes 202, 204 that extend toward and/or to the lateral and medial side edges, respectively, of the sole structure 200 and are provided to accommodate sole flexibility during foot motion.

This example sole structure 200 includes a spanning portion 206 that supports the wearer's foot (e.g., foot support surface 200S and a portion or volume of the sole structure 200 thickness below that surface 200S) and an articulated portion 208 (e.g., the bottom surface 200B and the upwardly siped thickness above it). See FIGS. 2H and 2I. The spanning portion 206 includes the portion of the sole structure 200 above the upwardly extending sipes 202, 204, 210. The articulated portion 208 includes multiple discrete hexagonal sole elements 212 and/or other sole elements that are defined by the sipes 202, 204, 210. The sipes 202, 204, 210 extend upward into the articulated portion 208 from the bottom surface 200B of the sole structure 200. The hexagonally shaped sole elements 212 defined by the sipes 210 extend downward from (and may be integrally formed with) the spanning portion 206 of the sole structure 200.

All of the sipes 202, 204, 210 and hexagonally shaped sole elements 212 can be seen in FIG. 2A, which shows the exposed bottom surface 200B of this example sole structure 200. Only some of the sipes 202, 204, 210 and sole elements 212 are labeled in FIG. 2A (and the other figures). Various siping features of this example sole structure 200 now will be described in more detail with reference to FIGS. 2A-2J.

Referring again to FIG. 2A, a bottom view of an exposed bottom surface 200B of articulated sole structure 200 is shown. For clarity, only some of the elements described below are labeled in the figures. The articulated sole structure 200 includes multiple sipes 202, 204, 210 formed in the bottom surface 200B and extending upward into the articulated sole structure 200. The sipes 202 may extend in a generally transverse direction to the lateral side edge of the sole structure 200, and the sipes 204 may extend in a generally transverse direction to the medial side edge of the sole structure 200. The sipes 210 are arranged so as to form a hexagonal pattern across at least a portion of the bottom surface 200B of the sole structure 200. As shown in FIG. 2A, the sipes 210 formed in the bottom surface 200B of the sole structure 200 include multiple sipes 210*a* that are substantially side-to-side or transversely oriented and extend in a generally side-to-side or transverse direction of the sole structure 200. The transversely oriented sipes 210*a* may thus be referred to as "transverse sipes," although they may not extend precisely in the footwear transverse direction as that term is defined above. These "transverse sipes" 210*a* may extend in a direction substantially parallel to the side edge sipes 202 and/or 204.

The sipes 210 formed in the bottom surface 200B of this example sole structure 200 also include sipes 210*b*, 210*c* that are obliquely oriented relative to the transverse sipes 210*a* and extend in a generally slantwise direction relative to the transverse sipes 210*a*. The obliquely oriented sipes 210*b*, 210*c* thus may be referred to as "oblique sipes." In this illustrated example 200, oblique sipes 210*b* extend in a generally rear lateral-to-forward medial direction and oblique sipes 210*c* extend in a generally rear medial-to-forward lateral direction. At least some (and in some examples, a majority or even all) hexagonal shaped sole elements 212 will include two opposite transverse sipes 210*a*, two opposite oblique sipes 210*b*, and two opposite oblique sipes 210*c* having the orientations as described above.

The portion of a sipe 210 defining an edge of a sole element 212, 214 may have a length between about 1.5 mm to about 25 mm, and in some examples, the length of a sipe 210 defining an edge of a sole element 212, 214 may be between about 2 mm and about 20 mm. As shown in FIGS. 2A-2D, the sipes 210 may include sipe segments 210*a*, 210*b*, and 210*c* arranged to form a hexagonal pattern on the articulated sole structure 200. A sipe 210 also may have a width of about 2 mm, or even about 1 mm (or even less), when in an unstressed condition (the sipe "width" may define the distance between adjacent sole elements 212, 214, if any, across the sipe). The depth of a transverse sipe segment 210*a* and/or an oblique sipe segment 210*b*, 210*c* (into the volume of the sole material) may vary, e.g., depending on the region of the articulated sole structure 200 at which the sipe segment is formed, e.g., the forefoot region, the midfoot region, or the heel region. In some example embodiments, the thickness of the articulated sole structure 200 may be greater at the heel region relative to its thickness at the forefoot region. In these example embodiments, at least some of the sipe segments 210 formed in the heel region may be deeper relative to at least some of the sipe segments 210 formed in the forefoot region of the sole structure 200. Moreover, the depth of a transverse sipe segment 210*a* and/or an oblique sipe segment 210*b*, 210*c* may be constant or may vary from one end of the sipe segment to another end thereof such that one end of the sipe segment may be shallower or deeper relative to its opposite end. Varying the depth of the sipes 210 may provide more or less flexibility when the articulated sole structure 200 is flexed about an axis.

The sipes 210 may merge with one another such that the sipes 210 are contiguous with one another. As seen in FIG. 2A, for example, at least one end of a transverse sipe segment 210*a* may merge with one or more oblique sipe segments 210*b*, 210*c*. Likewise, at least one end of an oblique sipe segment 210*b* or 210*c* may merge with a transverse sipe segment 210*a* or another oblique sipe segment 210*b*, 210*c*. Moreover, the transverse sipe segments 210*a* and the oblique sipe segments 210*b*, 210*c* may be arranged to form a hexagonal pattern on the bottom surface 200B of the articulated sole structure 200 as shown by way of example in FIGS. 2A-2D. The arrangement of the transverse sipe segments 210*a* and the oblique sipe segments 210*b*, 210*c* thus may define one or more sole elements 212 having a generally hexagonal shape, and optionally, a continuous matrix or array of hexagonally shaped sole elements 212 extending in two dimensions over the bottom surface 200B of the sole structure 200. The sole elements 212 having a generally hexagonal shape thus may be referred to as "hexagonal sole elements." The sipes 210 defining the hexagonal sole elements 212 may therefore correspond to the respective edges of the hexagonal sole elements 212. The continuous matrix or array of hexagonally shaped sole elements 212 may extend to cover at least 60% of a bottom surface 200B of the sole structure 200, and in some examples, may extend to cover at least 75%, at least 80%, at least 85%, or even at least 90% of a bottom surface 200B of the sole structure 200.

Furthermore, the junction of a transverse sipe segment 210*a* and an oblique sipe segment 210*b* and/or 210*c* may correspond to a vertex of a hexagonal sole element 212. A vertex of a hexagonal sole element 212 also may correspond to the junction of an oblique sipe segment 210*b* or 210*c* with another oblique sipe segment or to the junction of a transverse sipe segment 210*a* and a pair of oblique sipe segments 210*b*, 210*c*. Stated differently, one pair of transverse sipe segments 210*a* and two pairs of oblique sipe segments 210*b* and 210*c* may be arranged in a generally hexagonal configuration in the articulated sole structure 200 so as to define a hexagonally-shaped sole element 212 in the articulated sole structure 200. The hexagonally shaped sole elements 212 may be arranged such that the vertices of one sole element 212 (e.g., sole element A of FIG. 2A) nest within areas defined by adjacent sides of the adjacent and surrounding sole elements 212 (e.g., the six sole elements B-G in FIG. 2A).

The articulated sole structure 200 may include multiple discrete hexagonal sole elements 212 respectively defined by the transverse sipe segments 210*a* and the oblique sipe segments 210*b*, 210*c*. The hexagonal sole elements 212 may extend downward from a spanning portion 206 of the articulated sole structure 200. A hexagonal sole element 212 may be positioned next to one or more adjacent hexagonal sole elements 212. Hexagonal sole elements 212 that are adjacent to one another may share an edge defined by one of the transverse sipe segments 210*a* or one of the oblique sipe segments 210*b*, 210*c*. Hexagonal sole elements 212 that are adjacent to one another also may share one or more vertices defined by the junction of transverse sipe segments 210*a* and/or oblique sipe segments 210*b*, 210*c*. As shown by way of example in FIG. 2A, a hexagonal sole element 212 may be adjacent to multiple hexagonal sole elements 212 and therefore share multiple edges and vertices with adjacent hexagonal sole elements respectively. In the illustrated example sole structure 200, at least some of the hexagonal sole elements 212 (e.g., the one labeled "A") may share a single side edge with six adjacent and surrounding sole elements 212 (e.g., labeled B, C, D, E, F, and G), and this pattern may be repeated at multiple locations around the sole structure 200 (e.g., in the heel area; in the arch area; in the forefoot area; continuously spanning two or more of the heel, arch, and/or forefoot areas; etc.). As further shown, the vertices of at least some of the hexagonal sole elements 212 (e.g., the one labeled "A") may be nested within the areas defined between the adjacent side edges of the surrounding sole elements 212 (e.g., labeled B, C, D, E, F, and G).

Moreover, the transverse sipe segments 210*a* and/or the oblique sipe segments 210*b*, 210*c* may be arranged to at least partially define one or more sole elements 214 that do not have a hexagonal shape, but rather an alternative (e.g., other polygonal, incomplete hexagonal, etc.) shape. This may occur, for example, at the side edge areas of the sole structure 200 wherein sipe segments 210*a*, 210*b*, and/or 210*c* combine with edge sipes 202, 204 to form other sole element 214 shapes (e.g., pentagon shapes, etc.). Sole elements 214 that do not have a generally hexagonal shape may be referred to herein as "non-hexagonal sole elements." As shown in FIG. 2A, one or more portions of a non-hexagonal sole element 214 may resemble a portion of a hexagonal sole element 212. Accordingly, non-hexagonal sole elements 214 may share one or more edges and/or one or more vertices with one or more hexagonal sole elements 212. As seen in FIG. 2A, a portion of the medial edge or a portion of the lateral edge of the articulated sole structure 200 may define (and optionally interconnect) at least a portion of at least some of the non-hexagonal sole elements 214. Accordingly, at least one edge of a non-hexagonal sole element 214 may be defined by the lateral edge or medial edge of the sole structure 200.

As used herein, a "sipe" generally refers to a separation between sides of adjacent discrete sole elements (e.g., 212, 214). In some cases, a sipe may be the only thing separating and/or may leave little or no space between the sides of adjacent sole elements 212, 214 when the siped sole structure 200 is in an unloaded or unstressed condition (e.g., with no weight on the sole other than the weight of the sole structure 200 itself and/or the shoe in which the sole structure 200 is used). For example, side faces of adjacent sole elements 212, 214 separated by a narrow sipe 210 may actually be in contact with one another when the sole structure is unloaded, and there only may be space between those faces when the sole structure 200 flexes along that sipe. In other cases, a wider sipe (e.g., but still less than 5 mm) may create a larger gap between sides of adjacent sole elements 212, 214, and thus, there may be space between those sole element sides in the unloaded sole structure 200. In still other cases, a sipe may have a portion (e.g., the deepest part of the sipe) in which adjacent sole elements 212, 214 are in contact when the sole structure 200 is unloaded and another portion (e.g., the portion of the sipe near the bottom surface 200B of the sole structure 200) in which there is a groove or other space (e.g., less than 5 mm) between adjacent sole element faces 212, 214 in the unloaded sole structure 200.

Sipes 210 can be formed by molding, e.g., by including blades in a sole structure mold corresponding to desired sipe locations. Additionally or alternatively, sipes 210 can be formed by cutting sipes in a sole structure using a knife, laser, or other tool. Sipes 210 also can be formed using combinations of molding and cutting operations, as well as by other processes. In some embodiments, thinner sipes may be "knifed" (e.g., formed by cutting with a blade or laser), while wider sipes may be molded into a sole structure 200. In some such embodiments, the molded-in sipes may be located in areas of a shoe where higher stresses may be expected (e.g., at the heel, where a step lands, and at the toe, where step-off occurs). Molded-in sipes may in some cases be more durable than knifed sipes, as all sides of the sipe may be exposed to curing conditions and thus may have an outer crust of cured polymer material. Conversely, knifed sipes may be cut into the sole structure 200 after curing. Thus, knifed sipe side edges and their junction with the spanning portion 206 may constitute uncured polymer material that may be less durable than cured polymer.

Additional more specific aspects of the siping features and the hexagonal sole elements 212 in the illustrated example sole structure 200 now will be described with reference to FIGS. 2A through 2J. As mentioned above, this example sole structure 200 includes a foot-supporting surface 200S, e.g., that in this illustrated example extends longitudinally along an entire length of the sole structure 200 and transversely between the medial side edge and the lateral side edge of the sole structure 200. A ground-engaging or ground-facing surface 200B lies opposite the foot-supporting surface 200B and also extends longitudinally along the entire length of the sole structure 200 and transversely between the medial side edge and the lateral side edge of the sole structure 200. In this example one piece sole structure 200, a volume of sole material 230 (e.g., the polymer foam material as described above) exists between the foot-supporting surface 200S and the ground-engaging or ground-facing surface 200B to thereby define a thickness profile of the sole structure 200 between the foot-supporting surface 200S and the ground-engaging or ground-facing surface 200B.

In this sole structure 200, a plurality of sipes 202, 204, 210 (which may be interconnected with one another) extend from the ground-engaging or ground-facing surface 200B into the volume of sole material 230, and at least some of the plurality of sipes 202, 204, 210 are arranged to form a hexagonal pattern and define a plurality of discrete hexagonally-shaped sole elements 212 at the ground-engaging or ground-facing surface 200B. As shown in the figures, the plurality of discrete hexagonally-shaped sole elements 212 in this example sole structure 200 includes:

(a) a plurality of heel-supporting hexagonally-shaped sole elements 212*h* (see FIG. 2C) defining a first diagonal (which may extend in a medial side-to-lateral side direction of the sole structure 200, optionally substantially in the transverse direction of the sole structure 200), a first diagonal dimension D1, a second diagonal (which may extend in the forward medial-to-rear lateral direction of the sole structure 200), a second diagonal dimension D2, a third diagonal (which may extend in the forward lateral-to-rear medial direction of the sole structure 200), and a third diagonal dimension D3, wherein at least two heel-supporting hexagonally-shaped sole elements 212*h* of the plurality of heel-supporting hexagonally-shaped sole elements 212*h* (and optionally at least four, at least eight, at least 16, or even at least 32 heel-supporting hexagonally-shaped sole elements 212*h*) include the following properties:

D1=0.8 D2 to 1.2 D2,

D1=0.8 D3 to 1.2 D3, and

D2=0.8 D3 to 1.2 D3, and optionally, D1, D2, and D3 may be equal to one another;

(b) a plurality of arch-supporting hexagonally-shaped sole elements 212*a* (see FIG. 2B) defining a fourth diagonal (which may extend in a medial side-to-lateral side direction of the sole structure 200, optionally substantially in the transverse direction of the sole structure 200), a fourth diagonal dimension D4, a fifth diagonal (which may extend in the forward medial-to-rear lateral direction of the sole structure 200), a fifth diagonal dimension D5, a sixth diagonal (which may extend in the forward lateral-to-rear medial direction of the sole structure 200), and a sixth diagonal dimension D6, wherein at least two arch-supporting hexagonally-shaped sole elements 212*a* of the plurality of arch-supporting hexagonally-shaped sole elements 212*a* (and optionally at least four, at least eight, at least 16, or even at least 32 arch-supporting hexagonally-shaped sole elements 212*a*) include the following properties:

D4=0.25 D5 to 0.6 D5,

D4=0.25 D6 to 0.6 D6, and

D5=0.8 D6 to 1.2 D6, and optionally D5 and D6 may be equal to one another; and (c) a plurality of forefoot-supporting hexagonally-shaped sole elements 212*f* (see FIG. 2D) defining a seventh diagonal (which may extend in a medial side-to-lateral side direction of the sole structure 200, optionally substantially in the transverse direction of the sole structure 200), a seventh diagonal dimension D7, an eighth diagonal (which may extend in the forward medial-to-rear lateral direction of the sole structure 200), an eighth diagonal dimension D8, a ninth diagonal (which may extend in the forward lateral-to-rear medial direction of the sole structure 200), and a ninth diagonal dimension D9, wherein at least two forefoot-supporting hexagonally-shaped sole elements 212*f* of the plurality of forefoot-supporting hexagonally-shaped sole elements 212*f* (and optionally at least four, at least eight, at least 16, or even at least 32 forefoot-supporting hexagonally-shaped sole elements 212*f*) include the following properties:

D7=0.8 D8 to 1.2 D8,

D7=0.8 D9 to 1.2 D9, and

D8=0.8 D9 to 1.2 D9, and optionally D7, D8, and D9 may be equal to one another and/or equal to any one or more of D1, D2, and/or D3.

The plurality of heel-supporting hexagonally-shaped sole elements 212*h* having the properties described above (and the properties described below) may be located between planes perpendicular to the longitudinal direction L of the sole structure 200 located at 0L and 0.25L (see FIG. 2E); the plurality of arch-supporting hexagonally-shaped sole elements 212*a* having the properties described above (and the properties described below) may be located between planes perpendicular to the longitudinal direction L of the sole structure 200 located at 0.25L and 0.56L; and the plurality of forefoot-supporting hexagonally-shaped sole elements 212*f* having the properties described above (and the properties described below) may be located between planes perpendicular to the longitudinal direction L of the sole structure 200 located at 0.56L and 1L. For purposes of this disclosure, "heel-supporting" sole elements are located between 0L and 0.25L; "arch-supporting" sole elements are located between 0.25L and 0.56L; and "forefoot-supporting" sole elements are located between 0.56L and 1L.

As evident from the above description and FIGS. 2A-2E, one or more of the arch-supporting hexagonally shaped sole elements 212*a* (and optionally at least 2, at least 4, at least 8, at least 16, or even at least 32 of the arch-supporting hexagonally shaped sole elements 212*a*) may have longer length dimensions LA (FIG. 2B) in a direction of the length of the sole structure 200 than length dimensions LH of one or more of the heel-supporting hexagonally-shaped sole elements 212*h* and/or length dimensions LF (in the direction of the length of the sole structure 200) of one or more of the forefoot-supporting hexagonally-shaped sole elements 212*f* (in the direction of the length of the sole structure 200). In some more specific examples, at least some of the LA dimensions will be from 1.2 to 3 times at least some of the LH and/or LF dimensions in a single sole structure 200, and in some examples, at least some of the LA dimensions will be from 1.4 to 2.5 times at least some of the LH and/or LF dimensions in a single sole structure 200. Optionally, each of at least four, at least eight, at least 16, or even at least 32 arch-supporting hexagonally-shaped sole elements 212*a* will have an LA dimension from 1.2 to 3 times (or even from 1.4 to 2.5 times) each of at least four, at least eight, at least 16, or even at least 32 of the LH and/or LF dimensions in a single sole structure 200.

As some additional potential and example properties, sole structures 200 according to at least some examples of this invention may have at least two heel-supporting hexagonally-shaped sole elements 212*h*, at least two arch-supporting hexagonally-shaped sole elements 212*a*, and at least two forefoot-supporting hexagonally-shaped sole elements 212*f* having any one or more of the following properties:

D1=0.9 D2 to 1.1 D2,

D1=0.9 D3 to 1.1 D3,

D2=0.9 D3 to 1.1 D3

D4=0.3 D5 to 0.5 D5,

D4=0.3 D6 to 0.5 D6,

D5=0.9 D6 to 1.1 D6,

D7=0.9 D8 to 1.1 D8,

D7=0.9 D9 to 1.1 D9,

D8=0.9 D9 to 1.1 D9.

D4=0.6 D1 to 1.1 D1,

D4=0.6 D7 to 1.1 D7,

D5=1.5 D2 to 2.5 D2,

D5=1.5 D8 to 2.5 D8,

D6=1.5 D3 to 2.5 D3, and/or

D5=1.5 D9 to 2.5 D9.

While sole structures 200 may have any desired sole element sizes without departing from this invention, in at least some examples of this invention, the at least two heel-supporting hexagonally-shaped sole elements 212*h*, the at least two arch-supporting hexagonally-shaped sole elements 212*a*, and the at least two forefoot-supporting hexagonally-shaped sole elements 212*f* will be sized and shaped such that each of D1, D2, D3, D4, D5, D6, D7, D8, and D9 is less than 30 mm, and in some examples, less than 25 mm. As some additional or alternative potential features, the at least two heel-supporting hexagonally-shaped sole elements 212*h*, the at least two arch-supporting hexagonally-shaped sole elements 212*a*, and the at least two forefoot-supporting hexagonally-shaped sole elements 212*f* will be sized and shaped such that each of D1, D2, D3, D4, D7, D8, and D9 is less than 12 mm, and in some examples, less than 10 mm, and each of D5 and D6 is greater than 12 mm, and in some examples, greater than 15 mm or even greater than 20 mm. In this manner, the hexagonally shaped sole elements 212 will be sized and shaped such that at least some of the arch-supporting hexagonally shaped sole elements 212*a* (e.g., at least 2, at least 4, at least 8, at least 16, or even at least 32 of the arch-supporting hexagonally shaped sole elements 212*a*) will be elongated in at least one direction (e.g., the sole structure's longitudinal direction L) and will be elongated as compared to the corresponding direction dimension(s) of at least some (e.g., at least 2, at least 4, at least 8, at least 16, or even at least 32) of the heel-supporting hexagonally-shaped sole elements 212*h* and/or at least some (e.g., at least 2, at least 4, at least 8, at least 16, or even at least 32) of the forefoot-supporting hexagonally-shaped sole elements 212*f*. At least some (and optionally, at least a majority) of the elongated arch supporting hexagonally shaped sole elements 212*a* will have longer longitudinal direction dimensions (LA) than corresponding longitudinal dimensions (LH and/or LF) of a majority of the heel-supporting hexagonally-shaped sole elements 212*h* and/or a majority of the forefoot-supporting hexagonally-shaped sole elements 212*f*. See FIG. 2E.

Figure 1C:
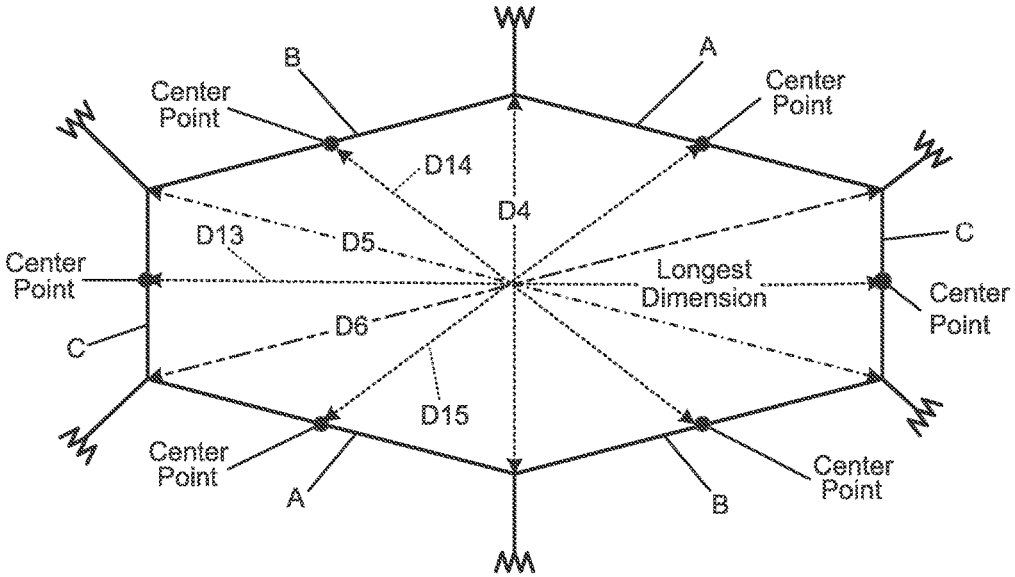

Additionally or alternatively, as illustrated in FIGS. 2A and 2B, at least some of the elongated hexagonally-shaped sole elements may have: (a) a first pair of opposite sides (e.g., like sides C in FIG. 1C), (b) a second pair of opposite sides (e.g., like sides B in FIG. 1C), and (c) a third pair of opposite sides (e.g., like sides A in FIG. 1C), wherein the first pair of opposite sides C are spaced apart by a greater distance D13 than a first spacing distance D14 between the second pair of opposite sides B and a second spacing distance D15 between the third pair of opposite sides A. The opposite side spacing distances D13, D14, D15, as shown in FIG. 1C, are measured from centerpoints of the opposite side walls or edges of the hexagonally shaped element. While other orientations of the elongated hexagonally shaped sole elements 212*a* are possible, in at least some examples of this invention, the center points of the first pair of opposite sides of at least some of the elongated hexagonally shaped sole elements 212*a* may be spaced apart in a direction parallel to a longitudinal direction L of the sole structure 200 or within 10° of parallel to the longitudinal direction L of the sole structure 200. The elongated hexagonally shaped sole elements (e.g., 212*a*) provide additional support at the various areas of the foot where they are located (e.g., at the midfoot/arch support area, along the medial edge, along the lateral edge, etc.) and/or may reduce flexibility in the areas in which they are located.

As some more specific example features, the opposite side spacing distances described above may have one or more of the following properties and/or features:

D13=1.1 to 2.5 D14,
D13=1.1 to 2.5 D15,
D13=1.25 to 2 D14,
D13=1.25 to 2 D15,
D14=0.8 to 1.2 D15,
D13=1.4 to 1.8 D14,
D13=1.4 to 1.8 D15,
D14=0.9 to 1.1 D15, and/or
D14=D15.

As further shown in FIGS. 2A-2E, if desired, at least some other areas of this example sole structure 200 may include elongated hexagonally shaped sole elements 212 without departing from this invention. As some more specific examples, FIGS. 2C and 2E show that some of the heel-support area (e.g., between perpendicular planes located at 0L and 0.25L) may include at least some elongated hexagonally shaped sole elements 212*h* (e.g., in some examples between perpendicular planes located at 0.15L and 0.25L, along the medial side area, etc.). These heel-support area elongated hexagonally shaped sole elements 212*h* may have any of the features and/or orientations described above for elongated hexagonally shaped sole elements 212*a* (e.g., the opposite side spaces, the orientation features, etc.). Also, while the heel-support area (e.g., between perpendicular planes located at 0L and 0.25L) and/or the forefoot-support area (e.g., between perpendicular planes located at 0.56L and 1L) may include some elongated hexagonally shaped sole elements as described and/or defined above, in at least some examples of this invention, a majority of the hexagonally shaped sole elements in the heel-support area (e.g., between perpendicular planes located at 0L and 0.25L) and/or the forefoot-support area (e.g., between perpendicular planes located at 0.56L and 1L) will not be elongated, e.g., will not have the elongated properties as described above (e.g., they will be or will be close to more "regular" hexagonal shaped, for example, with all sides having a length A±10%).

Rather than or in addition to separate outsole components, FIGS. 2B-2D further illustrate that the bottom surface 200B of the sole structure 200 according to at least some examples of this invention may include small raised ridges 250 that may function to provide increased traction. In this illustrated example structure 200, the raised ridges 250 are integrally formed as part of the bottom surface 200B of the sole structure 200 (e.g., in the surface of the sole material 230) during its production (e.g., the raised ridges 250 may be molded into the surface 200B). While a wide variety of raised rib shapes and/or patterns may be used, the raised ridges 250 in this illustrated example structure 200 have the appearance of a series of enclosed rings or whorls and may have an aesthetic appearance akin to a finger print. While any desired dimensions are possible, in the illustrated example, the raised ridges 250 are less than 2 mm high (and in at least some areas and/or examples, less than 1 mm high) and/or less than 3 mm wide (and in some areas and/or examples, less than 2 mm wide). The sipes 202, 204, and/or 210 may be made through the raised ridges 250. Additionally or alternatively, if desired, additional traction may be provided using other types of structures (e.g., slits; cleats; more pronounced ridge structures; grooves; attached components; etc.).

The raised ridges 250 shown in the figures are just one example of potential raised ridge shapes, appearances, and/or configurations that could be used in sole structures in accordance with this invention. Raised ridges 250 could be provided in a wide variety of other patterns, sizes, and/or shapes (e.g., more or fewer rings could be provided, different ring shapes could be provided, different spacings between rings could be provided, taller or shorted ridges could be provided, wider or narrower ridges could be provided, etc.). Additionally or alternatively, raised ridges 250 could be provided in patterns that do not include a series of rings or whorls, such as in a matrix pattern; a criss-cross pattern; in multiple, separated areas; etc. Optionally, the raised ridges 250 also could be omitted without departing from the invention.

Additional potential features of sole structures 200 according to at least some examples of this invention are shown with respect to FIGS. 2F-2J. FIG. 2F shows a top view of the foot-supporting surface 200S of the sole structure 200. In this illustrated example, the foot-supporting surface 200S includes a plurality of sipes 220 extending from the foot-supporting surface 200S into the volume of sole material 230 in a forefoot area of the foot-supporting surface 200S. Similarly, this example foot-supporting surface 200S includes a plurality of sipes 222 extending from the foot-supporting surface 200S into the volume of sole material 230 in a heel area of the foot-supporting surface 200S. While other patterns are possible, in this illustrated example, at least some of the plurality of sipes 220, 222 extending from the foot-supporting surface 200S form a hexagonal pattern such that hexagonally shaped foot-support elements 224 are provided at various locations at the foot-supporting surface 200S. At other areas of the foot-supporting surface 200S, the sipes 220, 222 form only three sided vertice areas 226, e.g., of a hexagonal support surface sipe pattern, and/or "Y" shaped intersecting sipe arrangements. In this illustrated example, the siping 220, 222, 226 is provided only at certain areas of the foot-supporting surface 200S (e.g., in the heel support area and the forefoot support area with a distinct gap in the siping across a portion of the arch support area), although it could be provided over a greater or lesser proportion of the surface 200S, if desired (including over the entire surface).

While it is not a requirement, if desired, the hexagonal pattern of foot-support elements 224 on the foot-supporting surface 200S may have sizes and shapes corresponding to the pattern and/or align with the pattern of hexagonally shaped sole elements 212 at the ground-contacting or ground-facing surface 200B of the sole structure 200.

As further shown in the heel and forefoot partial cross-sectional views of FIGS. 2H and 2I, respectively, at least some of the foot-supporting surface 200S sipes 220, 222, 226 may have a depth into the material 230 of the sole structure 200 within a range of 0.5 mm to 4 mm, and in some examples, within a range of 1 mm to 3 mm, or even about 2 mm. At least some of the ground-contacting or ground-facing surface 200B sipes 202, 204, 210 may have a depth into the material 230 of the sole structure 200 within a range of 2 mm to 15 mm, and in some examples, within a range of 3 mm to 15 mm, from 4 to 12 mm, or even about 8 mm. In such constructions, the material 230 of the sole member 200 may have a sufficient thickness so as to leave a band of "un-siped" sole material 230 between the upper sipes 220, 222, 226 and the lower sipes 202, 204, 210 (in a direction between the top surface 200S and bottom surface 200B) of from 3 mm to 24 mm at least at some locations. As some more specific examples, in the heel area (e.g., FIG. 2H), the unsiped band may have a thickness in the range of 6 mm to 24 mm, and in some examples, within a range of 8 min to 20 mm, or even from 10 mm to 16 mm at least at some locations. In the forefoot area (e.g., FIG. 2I), the unsiped band may have a thickness in the range of 2 mm to 18 mm, and in some examples, within a range of 4 mm to 16 mm, or even from 6 mm to 10 mm at least at some locations. The "unsiped" thickness of the sole material 230 is provided between and separates the plurality of sipes 202, 204, 210 extending from the ground-engaging or ground-facing surface 200B of the sole structure 200 and the plurality of sipes 220, 222, 226 extending from the foot-supporting surface 200S of the sole structure 200. The siping 220, 222, 226 at the foot-supporting surface 200S, when present, can help better translate the feel of the ground and/or transmit sensations to the wearer's foot (e.g., by "activating" the individual foot support elements 224 to push upward on the wearer's foot). Optionally, the foot-supporting surface 200S siping 220, 222, 226 may be omitted, if desired.

FIGS. 2F, 2G, and 2J illustrate additional features of sole structures in accordance with at least some examples of this invention. As shown in these figures, the sole structure 200 of this illustrated example includes a perimeter side wall 200W terminating at a perimeter rim 200P and extending upward from the foot-supporting surface 200S at least at a rear heel area of the sole structure 200. The sole material 230 provided between the foot-supporting surface 200S and the perimeter rim 200P forms the side wall 200W, and this side wall 200W extends at least around the rear heel area (e.g., from perpendicular planes located at 0L to 0.15L or even 0L to 0.25L). The side wall 200W and perimeter rim 200P are formed of the sole material 230 and are integrally formed with and extend upward from the foot-supporting surface 200S, at least at the rear heel area of the sole structure 200. In this manner, the side wall 200W above the foot-supporting surface 200S up to the perimeter rim 200P form a pocket (e.g., a rear heel pocket 240), e.g., into which a portion of a footwear upper can be received (as described in more detail below). In this manner, the side wall 200W and perimeter rim 200P may form a heel support (e g, akin to a type of heel counter structure) and/or may provide upper shape support.

As further shown in FIGS. 2F, 2G, and 2J, the side wall 200W may be rounded and curve back to extend partially over a portion of the foot-supporting surface 200S at the rear heel area. The extent of the foot-supporting surface 200S is shown generally by the broken lines labeled 242 in FIGS. 2G and 2J, and the foot-supporting surface 200S smoothly curves upward to transition into and form the side wall 200W. In this manner, the side wall 200W is formed of a thin band of the sole material 230. In some example, structures, the perimeter side wall 200W and/or the perimeter rim 200P may define a free (upper) edge 200E of the sole member 200, e.g., around the pocket 240. This upper free edge 200E may extend at least 1 inch in a perimeter direction around the top of the sole member 200, and in some examples, it may extend around the perimeter direction at least 2 inches, or even at least 3 inches (e.g., around the rear heel area from the lateral side of the sole member 200 to the medial side of the sole member 200). This upper or free edge 200E may constitute a thin band of sole material 230 extending at least 0.25 inch in a height direction H, and in some examples, at least 0.5 inch or even 0.75 inch in the height direction H (e.g., the height direction being measured perpendicular and downward from the perimeter rim 200P). Further, this upper free edge 200E may have a thickness dimension T (from one side surface to the other side surface) of no more than 0.5 inch over the height dimensions H mentioned above (and in some examples, no more than 0.25 inch thick or even no more than 0.175 inch thick over the various height dimensions H mentioned above). The upper or free edge 200E band need not have a constant height dimension H as it extends around the perimeter direction and/or it need not have a constant thickness dimension T over its height dimension H and/or around the perimeter direction.

Sole structures 200 of the various types described above may be incorporated into any desired style or type of footwear, including athletic footwear, casual wear footwear, etc. As some more specific examples, the sole structures 200 may be engaged with an upper made from one or multiple pieces, e.g., in manners conventionally known and used in the art. In some examples, the sole structures 200 may be engaged with a bottom surface of an upper (e.g., a strobel member, a lasting board, etc.) and/or with a side surface of an upper by cements or adhesives, by mechanical connectors, by sewing or stitching, etc. As additional examples, if desired, sole structures 200 of the types described above may be used with uppers having a knit construction and/or uppers of the types described in U.S. patent application Ser. Nos. 14/247,941 and 14/247,981, each filed Apr. 8, 2014 and each entirely incorporated herein by reference. Suitable uppers for engagement with sole structures 200 also are described in U.S. Pat. Nos. 8,321,984 and 8,429,835, each of which is entirely incorporated herein by reference.

Figure 3A:
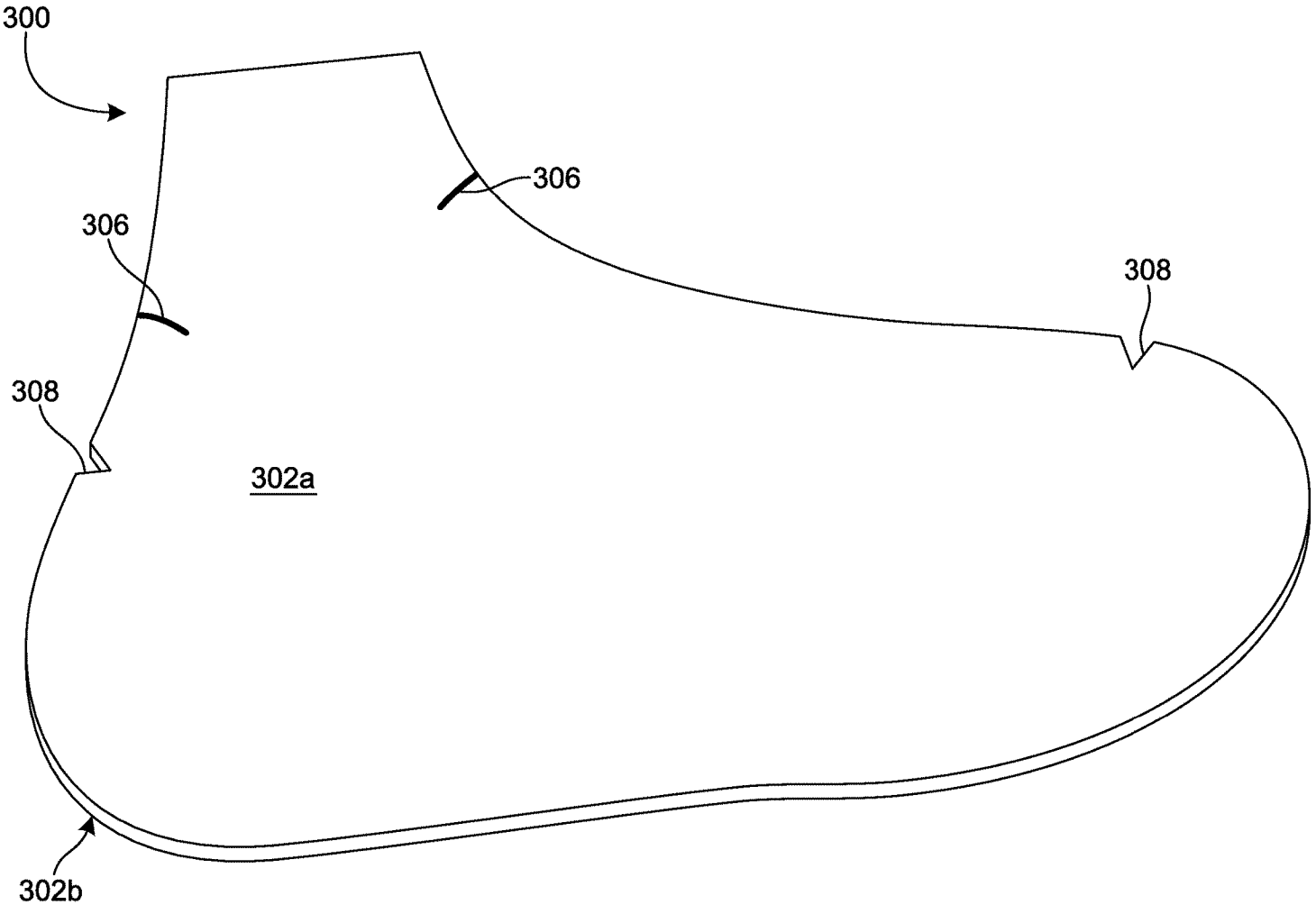
FIGS. 3A-3I provide various views showing construction of an upper component and a method of making an upper and an article of footwear in accordance with at least some examples of this invention.

FIGS. 3A-3I describe more specific example articles of footwear and methods of making them that include sole structures 200, e.g., of the various types described above. These aspects of this invention relate to methods of forming upper components for articles of footwear using pressing processes, such as flat-pressing procedures. FIG. 3A illustrates an example "jig" or base support member 300 that may be used in pressing processes according to at least some examples of this invention. The jig 300 of this example includes a first major surface 302*a* and a second major surface 302*b* opposite the first major surface 302*a*. The first and second major surfaces 302*a*, 302*b* may be flat and parallel, and they may be separated by an overall jig thickness dimension of less than 1 inch, and in some examples, less than ½ inch or even less than ¼ inch.

FIG. 3A shows the jig 300 as being made as least in part (and optionally totally) as a metal component. Such structures can be particularly useful in heat transfer steps that may be used in some methods according to this invention, such as for inductive heating of the jig 300. Also, FIG. 3A shows jig 300 as completely planar with two opposing, flat, parallel surfaces 302*a*, 302*b*. While this is a preferred arrangement in some embodiments of this invention, the surfaces 302*a*, 302*b* need not be perfectly flat and/or they need not be perfectly parallel. In other words, variations in the surface structures and/or surface orientations are possible without departing from this invention. As used in this specification, a base support surface will be considered "substantially flat:" (a) if at least 80% of the surface changes in elevation by less than ¼ inch from a mean surface level (exclusive of any openings extending completely through the base support) and/or (b) if at least 80% of the surface covered by an upper base member (described in more detail below) changes in elevation by less than ¼ inch from a mean surface level (exclusive of any openings extending through the base support). In other words, at least 80% of one of the actual surfaces described above lies within ±¼ inch of a central plane for the surface. Also, as used in this specification, base support surfaces will be considered "substantially parallel:" (a) if a direct thickness between the opposite surfaces varies by less than 15% over at least 80% of the overall surface area (exclusive of any openings extending completely through the base support) and/or (b) if a direct thickness between the opposite surfaces varies by less than 15% over at least 80% of the surface area covered by an upper base member (exclusive of any openings extending completely through the base support). The terms "substantially flat" and "substantially parallel" also encompass and include perfectly flat and perfectly parallel surfaces, respectively.

FIG. 3A further shows all (100%) of this example jig 300 as having flat and parallel surfaces. Other arrangements are possible without departing from this invention. For example, if desired, the portion of the jig 300 (if any) that will extend outside of an upper base member during production processes may include a ball, hole, slot, groove, ridge, ring, or other structure, e.g., to enable the jig 300 to be grasped or handled more easily (e.g., by robotic arms or other machinery, by an operator, etc.).

If necessary or desired, the jig 300 may include heating elements or resistors on one or both surfaces 302*a*, 302*b*. The heating elements or resistors may be formed to have a flat structure and/or may be recessed into the surface(s) 302*a*, 302*b* such that the overall jig surface(s) 302*a*, 302*b* maintain substantially flat and/or substantially parallel characteristics as described above. If desired, a single heating element and/or single resistor may be provided to simultaneously heat both sides or surfaces 302*a*, 302*b* of the jig 300 at a specific location. While the heating elements or resistors may be powered in any desired manner, if necessary, conductor leads may be provided for supplying power to the heating elements or resistors. As yet some more specific examples, flexible heating elements (such as heating elements in/on a silicone base or membrane) may be used in at least some examples of this invention. Flexible heating elements of suitable constructions are known and are commercially available.

Figure 3B:
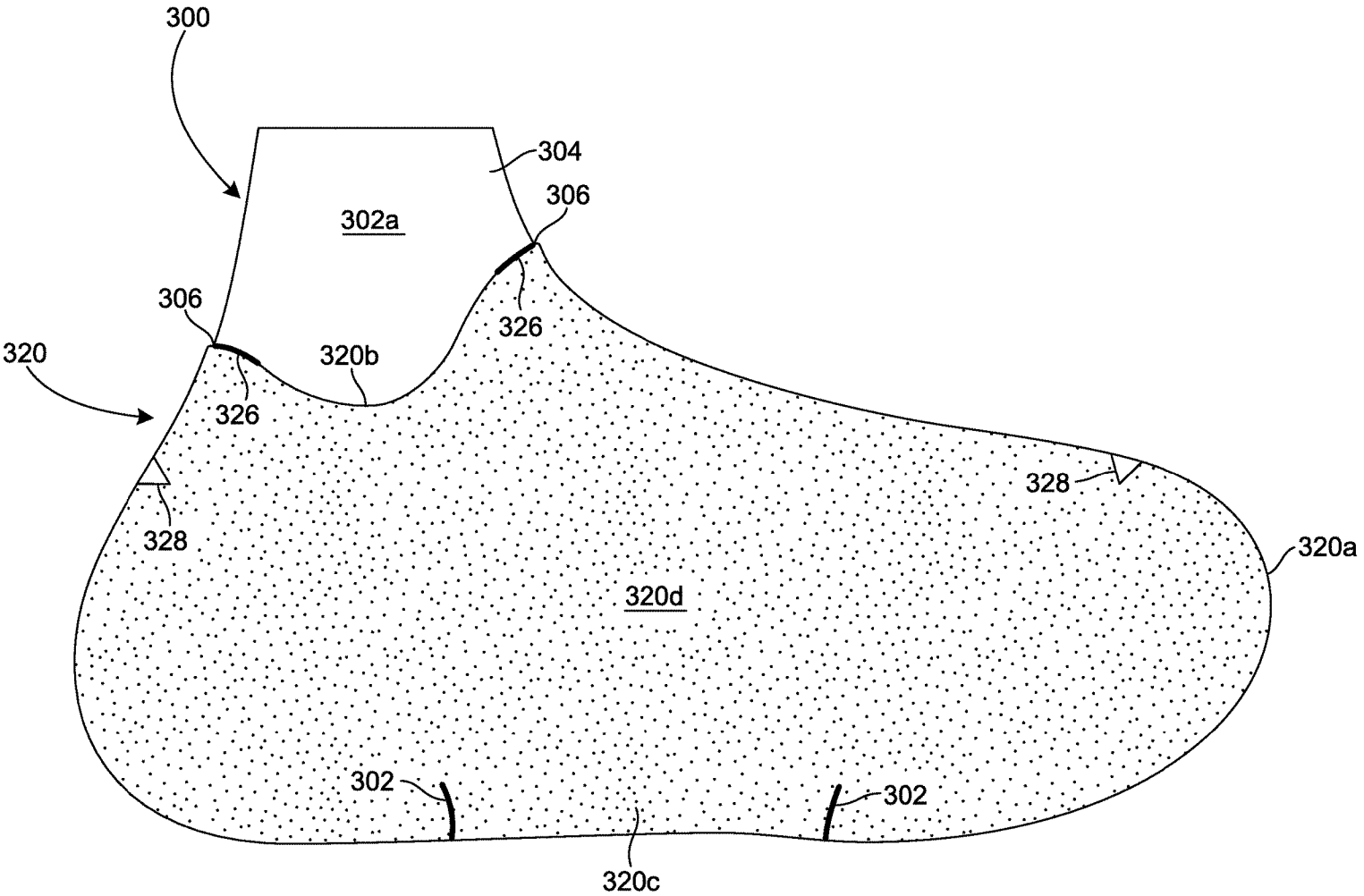

FIG. 3B illustrates an upper base member 320 fit onto substantially flat jig 300, e.g., of the various types described above. In this illustrated example, the upper base member 320 constitutes a conventional ankle high sock structure, e.g., having a circular knit structure with one closed end 320*a* (optionally closed by a sewn seam) and one open end 320*b*, through which the jig 300 is inserted into the enclosed interior chamber defined by the sock. While other circular knit and/or sock-type structures may be provided as an upper base member 320, in at least some examples of this invention, at least some of the upper base member 320 will constitute a textile component, e.g., formed from textile fibers, knitted, woven, and/or otherwise incorporated together. The jig 300 may be shaped so as to substantially fill the interior chamber defined by the upper base member 320, but it may further include a portion 304 that extends out of and beyond the open end 320*b* of the upper base member 320. This extending portion 304 may be used, for example, for engaging the jig 300 with another component (e.g., manufacturing machinery) and/or for otherwise handling the jig 300. Additionally or alternatively, the upper base member 320 may be specially shaped (different from a conventional sock shape, if desired) to better engage around and/or accommodate the jig 300.

If desired, the upper base member 320 and/or the jig 300 may include markings, indentations, notches, and/or other components or indicia provided for alignment purposes (e.g., to assure that the upper base member 320 is properly oriented on the jig 300 for further processing). FIG. 3A illustrates jig 300 as including one or more indicia 306 with which the top rim 326 of the upper base member 320 is to align when properly mounted on the jig 300 (see FIG. 3B). FIG. 3A further illustrates one or more notches or indentations 308 formed in the jig 300, and the operator can engage the upper base member 320 with the jig 300 so that the notch(es) or indentation(s) 308 align with indicia 328 or other features provided on the upper base member 320 (e.g., by feeling the notch(es) or indentation(s) 308 through the fabric material of the upper base member 320). While specific example top rim, rear heel, and top toe alignment aids are shown in FIGS. 3A-3B, any desired numbers, arrangements, and/or types of alignment aids can be used without departing from this invention. Also, if desired, at least some of the alignment aids and/or indicia may be removable from the upper base member 320 (e.g., washed off, etc.) so that they do not appear in the final upper construction. Additionally or alternatively, if desired, features of the alignment aids and/or indicia may be incorporated to blend into and/or form a portion of an overall aesthetic design of the upper component.

Some aspects of this invention relate to using a sock or other similar upper base member 320 as a base for forming a footwear upper component. In this manner, a footwear upper can be formed having a compliant, form fitting structure that can be incorporated into an article of footwear. The use of this type of sock or sock-like structure also can eliminate the need to use and engage upper components with a strobel member and/or the need to close off the heel area of the upper by stitching or sewing. The bottom, plantar support surfaces of such upper components may be continuous with the sides and seamless. Such upper base members 320 (formed as socks or sock-like structures) also may be stretchable, form fitting, and comfortable to the wearer.

It would not always be desirable, however, to simply use a sock structure (or other similar, plain textile component) alone as an upper component because such textile components generally do not have the necessary construction to adequately perform some of the desired functions of a footwear upper. For example, some footwear uppers provide various support and/or containment functions, such as shape support, heel area support (e.g., heel counter type structures), lace or other securing system supports, motion control functions, foot positioning functions, etc. Additionally, some footwear uppers provide water-resistance, waterproofing features, stain resistance, dirt resistance, abrasion resistance, durability, and the like. Also, footwear uppers may help provide desired aesthetics (e.g., colors and color combinations) to the overall shoe construction. Conventional socks, by themselves, or even if engaged with a separate footwear sole structure, may not provide all the desired functions of a footwear upper.

Figure 3C:
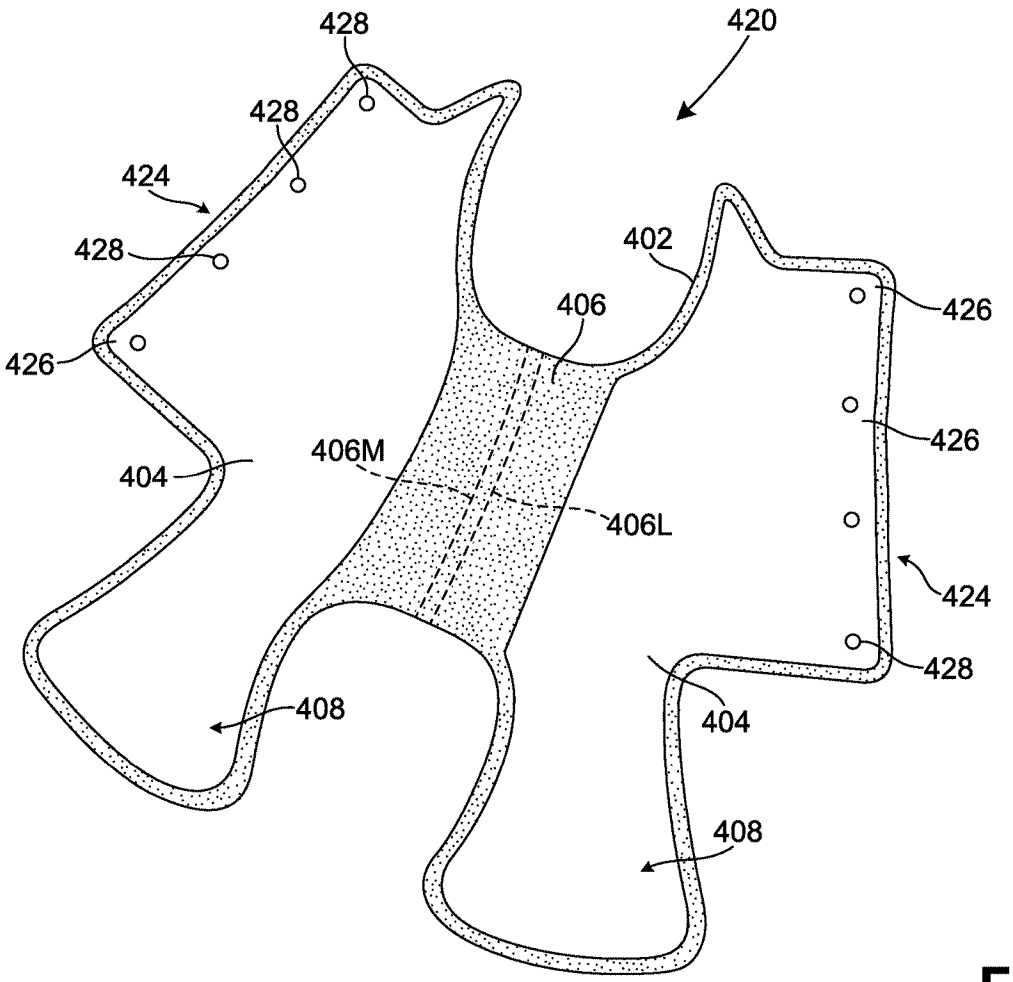

Therefore, in accordance with at least some examples of this invention, a conventional sock or other upper base member 320 (e.g., a sock-like structure, a circular knitted component, etc.) may be engaged with one or more "support members." FIG. 3C illustrates one example support member 420 of a "wrap around" type that is configured as a contiguous (but optionally multi-part) structure that wraps around the bottom 320*c* of an upper base member 320 when mounted on a jig 300 and extends along an exterior surface 320*d* of the upper base member 320 along both sides of the jig 300. One or more "wrap around" support members 420 of this type may be provided with a single upper base member 320 without departing from this invention. Various example features of this example support member 420 are described in more detail below.

Support member 420 includes an exterior base component 402 to which additional support materials 404 may be engaged, e.g., on opposite sides of a central area 406 of the exterior base component 402. In use, this example support member 420 will be oriented with respect to an upper base member (e.g., 320) in a manner such that the additional support materials 404 will directly face and contact opposite sides of the exterior surface (e.g., 320*d*) of the upper base member 320. Thus, an underside or interior of the support member 420 is illustrated in FIG. 3C. A bonding or adhesive material, e.g., such as hot melt material, may be provided on some or all of the interior surface(s) of exterior base component 402 and/or additional support material(s) 404. The additional support material 404 may be made of EVA, polyurethanes or other foams; textiles; inelastic components; plastics; metals; etc. Materials including the upper materials described in U.S. Pat. No. 8,429,835 may be used for base component 402 and/or additional support materials 404. The additional support materials 404, when present, may be engaged with the exterior base component 402 in any desired manner, such as by adhesives or cements, by stitching or sewing, by mechanical connectors, etc.

This example support member 420 includes side heel support areas 408 (for both the lateral and medial sides). More or fewer separate areas of support material 404 may be provided on each side of the support member 420, if desired, without departing from this invention, and the two sides may have different numbers and/or patterns of support areas 404, if desired. The central area 406 of the exterior base component 402 supports the arch area of a wearer's foot, and in this example, remains uncovered by additional support material 404. More, less, and/or different areas of the plantar surface may be supported by the base component 402 and/or additional support component(s) 404, if desired.

The instep/midfoot support areas 424 in this example structure 420 include lace engaging structures 426 that extend along the medial and lateral sides of the footwear upper component in the final upper construction. While one strip of lace engaging structures 426 is shown on each side of support member 420 in this example (e.g., a lateral side instep component and a medial side instep component), more or fewer support strips 226 may be provided (and/or a different number of support strips 426 may be provided on opposite sides) without departing from this invention. If desired, the outer edges of these strips 426 may include holes, eyelets, loops, and/or other structures 428 for engaging a lace or other securing system for the final upper component. The outer edges of strips 426 may be free of bonding or adhesive material, if desired, so that the edge can be moved away from the upper base member 320 to allow easy engagement with a lace.

The additional support materials 404 may overlay or underlay other components or structures of support 420 including exterior support 402, and these components 402, 404, etc. provide one or more desired characteristics to locations of the overall upper, such as shape support, stiffness, durability, abrasion resistance, water resistance, impact force attenuation, lace or engaging system support, etc. Again, any desired portion or proportion of support 420 (e.g., supports 402 and/or 404 (if any)) may have bonding or adhesive material applied to it, e.g., by coating, spraying, etc., so as to enable the support 420 to be engaged with an upper base member 320 as will be described in more detail below.

Figure 3D:
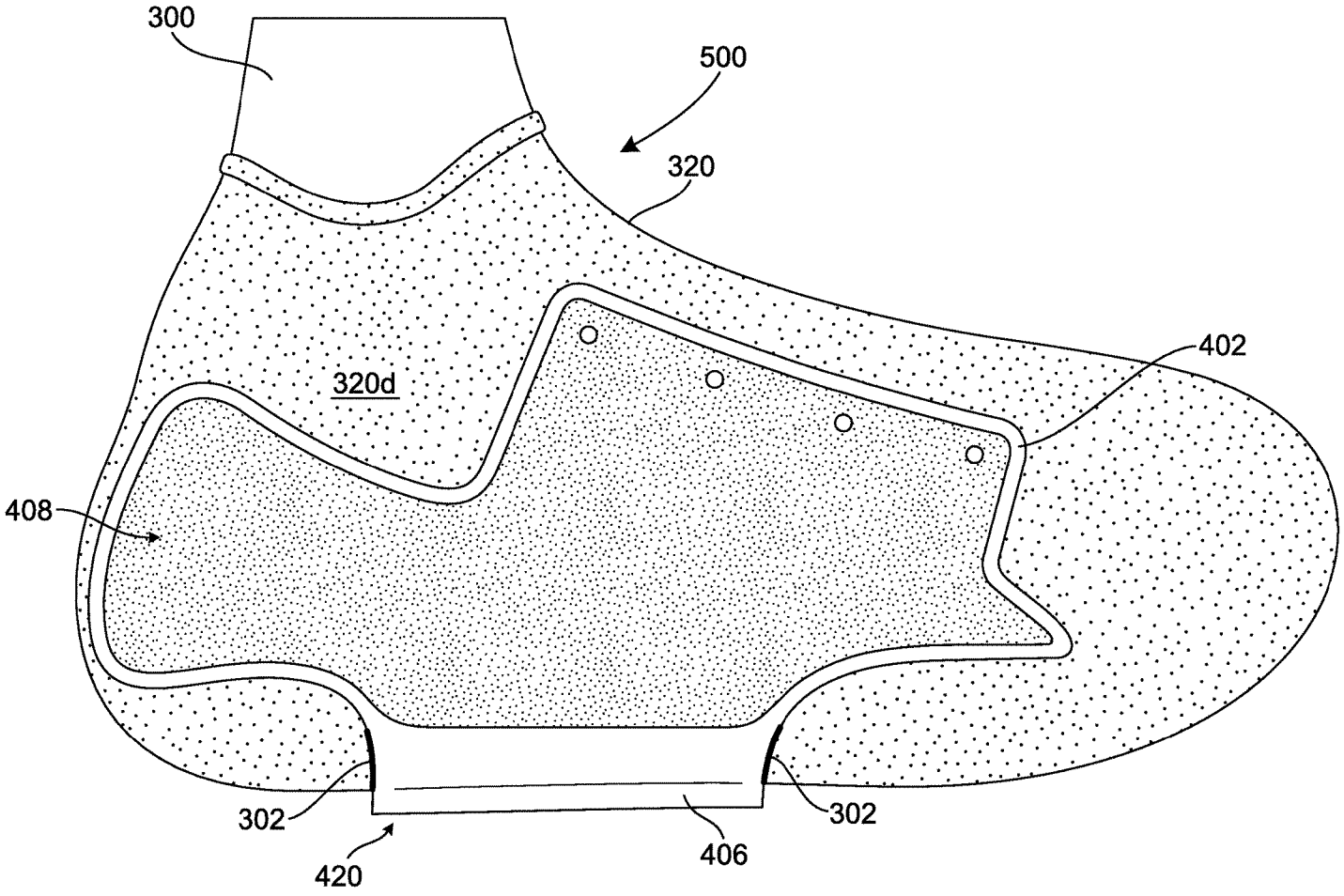

FIG. 3D illustrates an example of an upper base member 320 engaged with a jig 300 (e.g., as shown in FIG. 3A), with support member 420) wrapped around and engaged with the exterior surface 320*d* of the upper base member 320. If necessary or desired, a light adhesive, mechanical connectors, and/or other temporary securing means may be used to temporarily engage the support member 420 with the upper base member 320 to hold it in place until a desired time for further processing (as will be described in more detail below). The overall combination or assembly of the jig 300, upper base member 320, and support member 420 is represented in FIG. 3D by reference number 500. Multiple support members may be provided on a single upper base member 320, if desired, including separate support members on each side of jig/upper base member, if desired (e.g., with a portion of central area 406 omitted).

While the figures show support member 420 as a relatively flat member, support members may have some non-flat shape/features without departing from this invention. For example, if desired, component 402 may be a molded structure (such as molded TPU) that does not have a completely flat shape. As an additional example, component 402 may have texturing or surface features. Additionally or alternatively, if desired, the additional support member(s) 404 may have some significant thickness such that the overall combination of base support 402 and additional support(s) 404 have a varying thickness over the area of support 420. Accordingly, it is not necessary that the support members 420 be completely or substantially flat.

Also, in some examples of this invention, the upper base member 320 and/or the support member 420 may include markings, indentations, notches, and/or other components or indicia provided for alignment purposes (e.g., to assure that the support member 420 is properly oriented on the upper base member 320). For example, FIGS. 3B and 3D illustrate upper base member 320 as including one or more indicia 302 with which the front and rear of the central area 406 of the support member 420 may be aligned. Other types, numbers, positions, and/or arrangements of alignments aids may be provided without departing from this invention. If desired, at least some of the alignment aids and/or indicia may be removable (e.g., washed off, etc.) so that they do not appear in the final upper construction. Additionally or alternatively, if desired, features of the alignment aids and/or indicia may be incorporated to blend into and/or form a portion of an overall aesthetic design of the upper component.

Figure 3E:
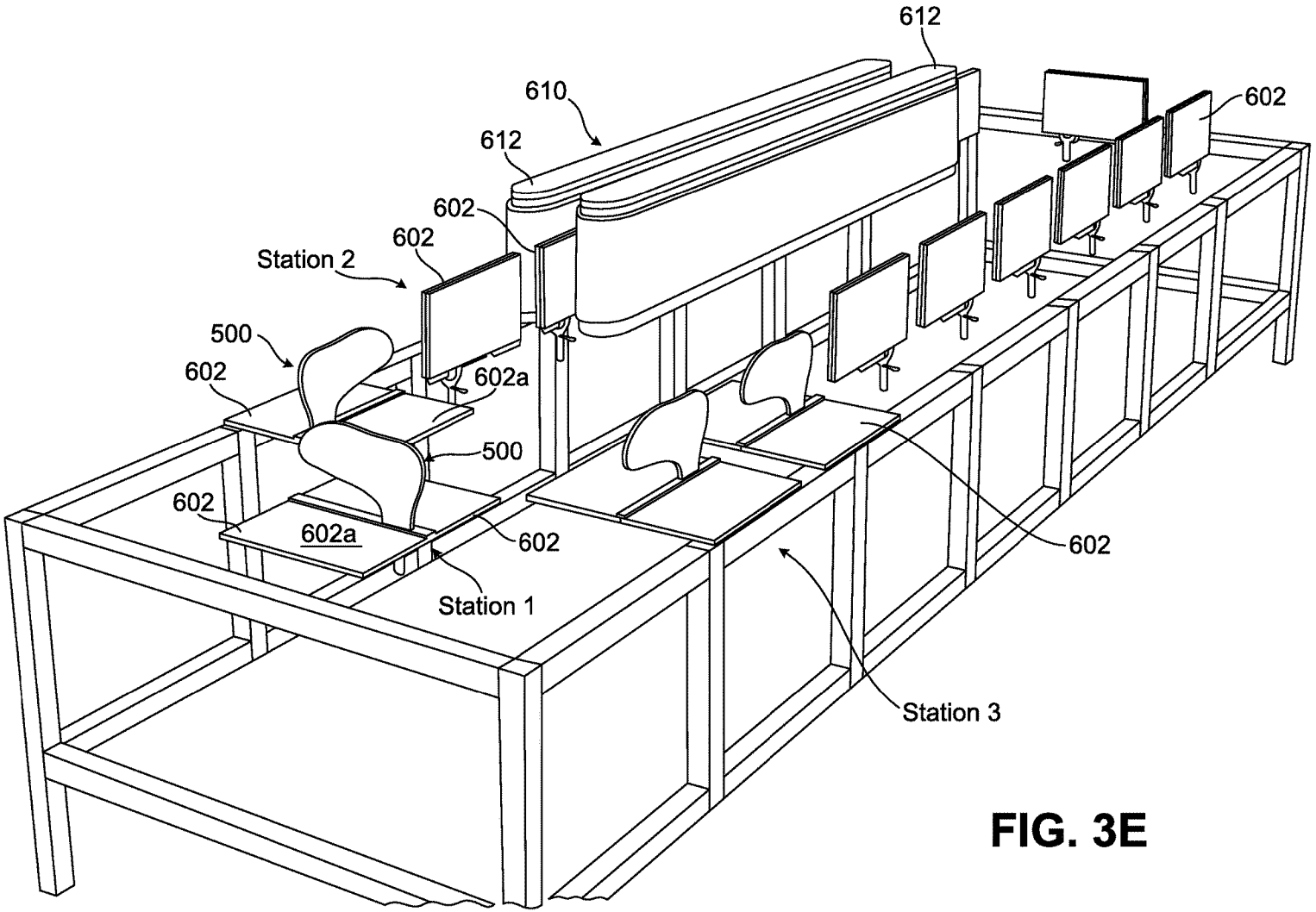

The support member 420 may be engaged with the upper base member 320, in at least some examples of this invention, by a flat pressing procedure. FIG. 3E illustrates an example "assembly line" diagram that schematically illustrates some examples and features of methods according to this invention. "Station 1" in this example is a loading station where an assembly 500 (e.g., including a jig 300, an upper base member 320, and a support member 420) is mounted to a conveyance system that moves the assembly 500 through the process. While other arrangements are possible, in this illustrated example, the assembly 500 is mounted "upside down" so that the bottom 406 of the base support member 420 is located at a top of the mounted assembly 500 and maintained in contact with the upper base member 320 under the force of gravity (and optionally by some additional securing means). The connection of the assembly 500 to the conveyance system further may include electrical connections and/or hardware/connectors for other components necessary or desired for the production process (e.g., connections or hardware for heating elements, for heating/coolant flow, for inductive heating, etc.).

In this illustrated example, the assembly 500 is substantially flat and thin. The mounted assembly 500 moves toward Station 2 along with two pressure plates 602, one provided on each side of the assembly 500. Optionally, the assembly 500 may be engaged with one or both pressure plates 602. The pressure plates 602 may be connected to one another (e.g., by a hinge or other structure) or they may be separate from one another. The pressure plates 602 may support some or all of the electrical connections and/or hardware described above. Once all components are properly mounted and oriented with respect to one another, the pressure plates 602 close around at least a portion of the assembly 500, as shown at Station 2 in FIG. 3E (e.g., so that pressure plate surfaces 602*a* contact the exterior of the assembly 500). In at least some examples of this invention, the portion of the assembly 500 located between the pressure plates 602 when closed and under compressive force may be less than 1 inch thick, and in some examples, less than ¾ inch thick, less than ½ inch thick, or even less than ¼ inch thick.

At this point, the interior surface of support member 420 (with at least some portion of its interior surface provided with a bonding or adhesive component, such as a hot melt layer) may be pressed against the outside 320*d* of the upper base member 320 under some level of compressive force. From Station 2, the assembly 500 between pressure plates 602 may be moved into and through a heat and/or compressive force application zone 610, as shown in FIG. 3E. The zone 610 may include additional pressure applying devices (e.g., compressive rollers 612), heating devices, cooling devices, and/or other hardware as necessary or desired to provide a desired level of heating and/or pressure to the assembly 500 located between the pressure plates 602. If desired, the zone 610 may include programmable components to allow application of controlled and programmable heating, pressing, and/or cooling protocols to the assembly 500. Also, if desired, the zone 610 may include coils and/or other appropriate components to induce inductive heating of jig 300. The applied heat and/or pressure in zone 610, optionally heating the hot melt material on support 402/404 from inside and through the material of the upper base member 320, causes the hot melt material of the support member 420 to melt and optionally draw into the structure of the upper base member 320 toward the heat source, which adheres the support member 420 to the upper base member 320.

After the assembly 500 leaves zone 610, if necessary, it may move along the conveyance system to a removal location, shown as Station 3 in the example of FIG. 3E. The conveyance system may move the assembly through a cooling zone, if desired (e.g., if zone 610 does not itself include a cooling area and/or cooling protocol). Alternatively or additionally, the pressure plates 602 may remain clamped around the assembly 500 (and still applying a compressive force to the assembly 500) for a sufficient time after they leave the zone 610 for cooling to occur and/or to assure an adequate bond has developed between the support member 420 and the upper base member 320. Other processing may occur between zone 610 and Station 3, if desired. At Station 3, the pressure plates 602 can be opened (e.g., rotated open about hinge connection) and the assembly 500 can be removed from the pressure plates 602.

In the example described above, the entire assembly 500 is attached to and removed from the pressure plates 602 and/or an area between pressure plates 602. Other arrangements are possible without departing from the invention. For example, if desired, jigs 300 may remain engaged with (optionally removably engaged with) the pressure plate(s) 602 and/or conveyance system. In such a system, at Station 1 the upper base member 320 and support member(s) 420 may be engaged and properly positioned with respect to one another and with respect to the jig 300, and at Station 3 the combined upper base member 320 and support member(s) 420 may be removed from its respective jig 300 as a combined, unitary, single component (referred to as element 720 below). This combined, unitary, single component 720, which may be comprised of a sock or sock-type component 320 having one or more support components 420 adhered to it by a bonding or adhesive material, then may be used for constructing an article of footwear as will be described in more detail below.

Also, while generally "flat pressing" processes are described with respect to FIGS. 3A-3E, if desired, the item pressed may have a three-dimensional structure. This may be accomplished in various ways. For example, if desired, the jig and pressure plates could be designed to have complementary shaped surfaces so as to allow pressure to be applied around the structure in various different directions. As another example, a three-dimensional jig and upper base member 320 (with one or more support members engaged therewith) could be mounted in a vacuum chamber in which an outer surface pulls inward under vacuum pressure to apply compressive force to the upper base member and jig surfaces inside the chamber.

Figure 3F:
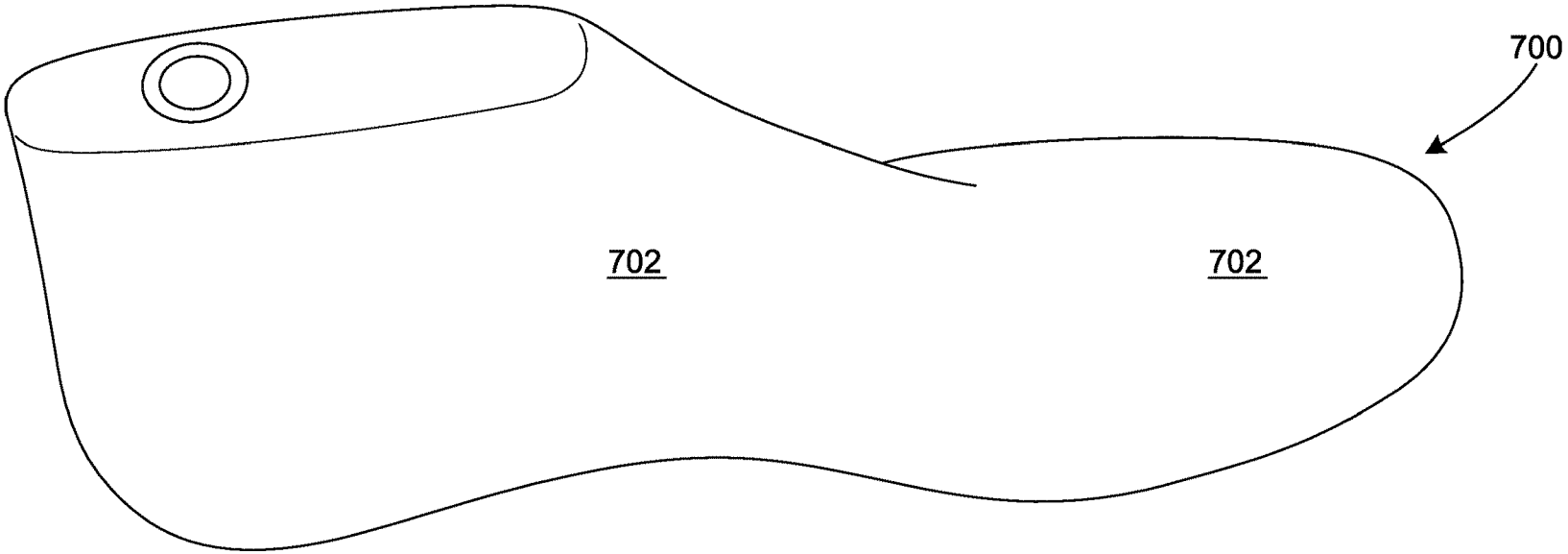

FIG. 3F illustrates a support base 700 used in making footwear structures in accordance with at least some examples of this invention. At least some portion(s) of the exterior surface 702 of support base 700 of this example may be sized and shaped to produce a desired final shape of a footwear upper product, as will be described in more detail below. As some more specific examples, one or more of the side heel areas, the rear heel area, the instep side areas, the lace support areas, the plantar surface support areas (i.e., the bottom surface), and/or the toe box area of the support base 700 may be sized and shaped as desired for the final footwear product. The support base 700 may be generally shoe shaped and/or may resemble a conventional footwear last.

Figure 3G:
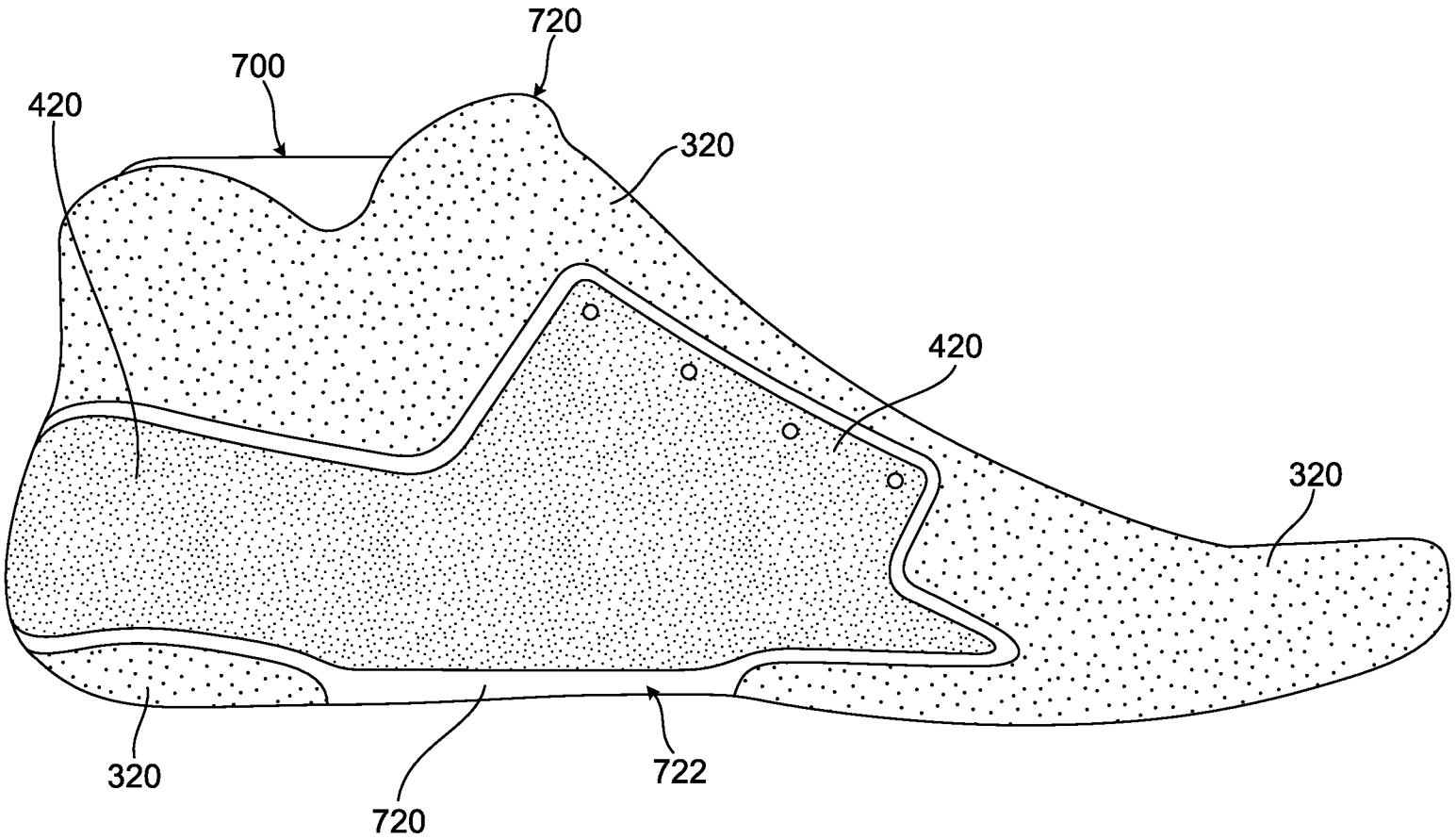
Figure 3H:
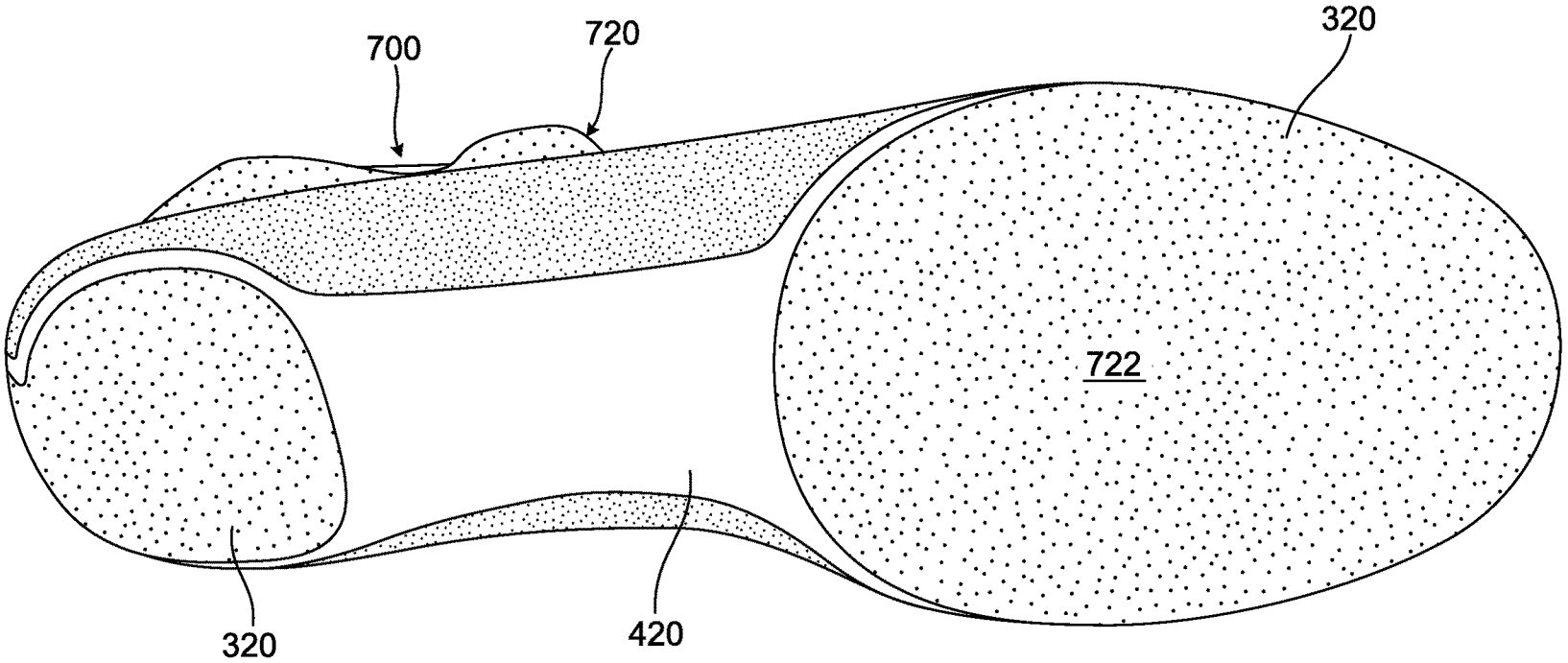

Next, as shown in FIG. 3G, the upper component 720 (e.g., as produced in the processes described in conjunction with FIG. 3E) is applied over the exterior surface 702 of the support base 700. FIG. 3H shows a bottom view of the combined upper component 720 mounted on the support base 700 (showing the outside of the plantar support surface 722 of the upper component 720). When placed on the support base 700, some or all of the support member 420 may be shaped and/or otherwise treated so as to be formed into and/or maintained in a desired shape (e.g., using thermoplastic or thermosetting properties, using shape memory materials, etc., the shape of at least some portion of the upper component 720 (e.g., support member 420) may be modified). Additionally or alternatively, if desired, at least some portions of the support member 420 and/or the upper base member 320 may be maintained in the desired shape at this stage solely by the presence of the underlying support base 700.

Notably, as shown in FIGS. 3G-3H, because the upper base member 320 starts out as a circular knitted component, e.g., a sock or sock-like structure, the bottom plantar support surface 722 (FIG. 3H) is a continuous structure such that no strobel element and/or bottom seam is needed to close off the foot-receiving chamber. Additionally, the rear heel area of this example upper base member 320 includes hot melt adhered areas 408 that are fixed to the upper base member 320 without the need for a rear heel seam and/or sewing step. These features provide a comfortable plantar support surface and/or eliminate significant manufacturing steps (thereby saving time, labor, and/or money) as compared to many conventional footwear structures and footwear production techniques.

Figure 3I:
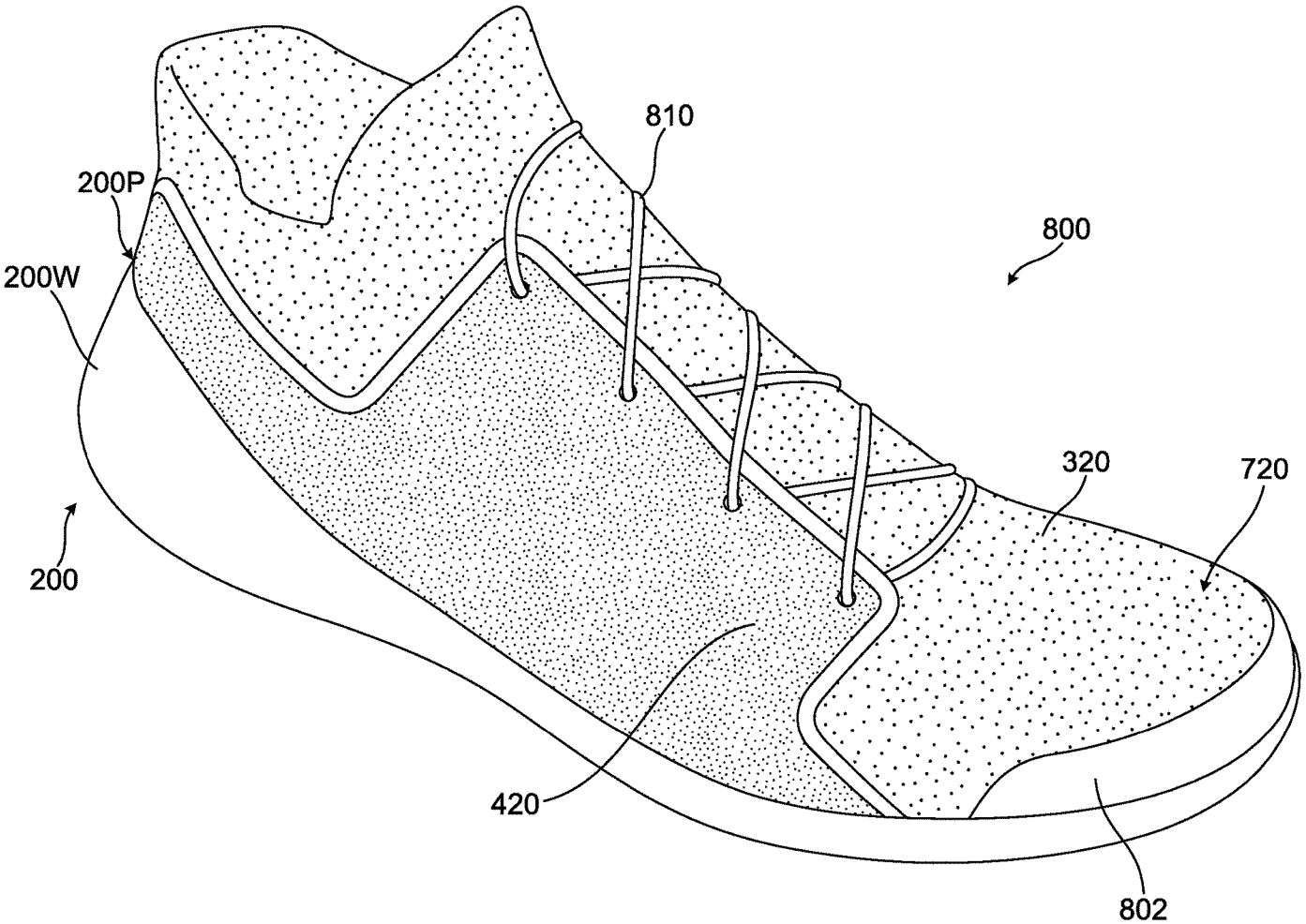

Then, optionally while the support base 700 remains inside the upper component 720, the upper component 720 may be engaged with at least a portion of a sole structure, e.g., to thereby form an article of footwear 800. For example, as shown in FIG. 3I, the upper component 720 (including an upper base member 320 and one or more support members 420) may be engaged with a sole structure 200 like those described above in conjunction with FIGS. 2A-2J. Any desired manner of connecting these components 720 and 200 may be used without departing from this invention, including manners conventionally known or used in the footwear art, such as one or more of: adhesive or cements (e.g., applied to portions of the exterior bottom and/or side surfaces of the upper component 720, applied to the top surface and/or side wall 200W of the sole structure 200, etc.); mechanical connectors, such as hook-and-loop type fasteners (optionally releasable mechanical connectors); sewing or stitching; etc.

Additional sole components or structures may be applied to the sole structure 200 and/or the upper component 720 without departing from the invention, such as one or more outsole elements (e.g., rubber or TPU ground contacting pads), cleat base components, cleats (permanently or removably mounted), cup-sole components, etc. Also, any desired manner of connecting these components or structures to the remainder of the structure may be used without departing from this invention, including manners conventionally known or used in the footwear art, such as one or more of: adhesive or cements, mechanical connectors, sewing or stitching, etc. In the illustrated example, a toe reinforcement structure 802 (e.g., made of rubber, plastic, TPU, leather, fabric, etc.) is engaged at the toe area of the upper component 720 (and optionally extending to an area behind the upper component 720 or between the sole structure 200 and the upper component 720) to provide shape support, durability, abrasion resistance, and/or foot protective properties to the footwear structure 800. The toe reinforcement structure 802 (e.g., which may constitute a top cap structure) may be engaged with the upper component 720 and/or sole structure 200, for example, using adhesives or cements, e.g., along with the step of engaging the upper component 720 with the sole structure 200.

Because of the sock type upper base member 320 in this example, a conventional tongue is not used in this example article of footwear 800 beneath the lace 810, as shown in FIG. 3I. Rather the sock or sock-like structure of the upper base member 320 extends continuously over the instep area where a tongue conventionally would be provided (and generally may perform the functions of a conventional tongue). Additionally or alternatively, if desired, a conventional tongue member could be provided (e.g., sewn to upper base member 320) and/or the upper base member 320 could be cut or slit from the ankle opening downward, along the instep, and toward the toe area between the opposite sides of support member 420 (e.g., if the upper base member 320 is not sufficiently stretchable to allow easy insertion and removal of a foot). A tongue member and/or instep slit may be provided, if desired, before the upper component 720 is engaged with sole member 200.

As further illustrated in FIG. 3I, in this footwear structure 800, the pocket 240 defined in part by the side wall 200W and/or the perimeter rim 200P of the sole structure 200 extends around and engages a side wall of the upper component 720 at least at the heel area so that a portion of the upper component 720 fits into the pocket 240. The side wall 200W of the sole structure 200 may be engaged with the side surface of the upper component 720 in this pocket area 240, e.g., using adhesives, mechanical connectors, etc. In this manner, at least a portion of the enclosed rear heel portion of the upper component 720 is engaged with an interior surface of the perimeter rim 200P and/or an interior surface of the side wall 200W.

The processes described above in conjunction with FIG. 3E utilized a substantially flat jig 300 to which a single piece upper base member 320 (e.g., a sock or sock-type structure) was applied. At least one single piece support member 420 was wrapped around a bottom 320*c* of the upper base member 320 (akin to a taco shell) to lie adjacent the opposing flat sides of the upper base member 320. Other options are possible. For example, for at least some materials, after pressing, a permanent crease is formed at the bottom of the upper base member 320 and/or the support member 420 (at the location of the fold). This crease can be undesirable (e.g., aesthetically displeasing, uncomfortable feeling to the bottom of the foot, adversely impacting bonding with other footwear components, etc.). Various ways of avoiding the issues created by this crease may be used in some methods according to this invention. For example, if possible, additional heat and/or pressure may be applied to the creased area over a flat or rounded surface to eliminate or reduce the severity of the crease (e.g., akin to ironing out the crease). As other examples, the underlying sole structure 200 (e.g., foam material) may be formed to include a sufficiently soft plantar support surface 200S and/or with a corresponding groove in the plantar support surface 200S (to accommodate the fold line) so that the crease is not substantially felt by the wearer.

Alternatively, rather than a wrapped configuration, one or more separate support members 420 may be applied to each side of the upper base member 320 in a manner so that none of the support members extends continuously around the bottom edge of the jig 300 and/or the bottom 320*c* of the upper base member 320. For example, FIG. 3C illustrates an alternative configuration of a two-piece support member 420 in broken lines in which the bottom area 406 of support member 420 is separated or cut to form a lateral side of the support member 420 (including free edge 406L at the bottom area 406) separated from a medial side of the support member 420 (including free edge 406M at the bottom area 406).

Then, returning to the processes described in conjunction with FIG. 3E, rather than folding and positioning a support member 420 to lie along and extend continuously across the top surfaces of the jigs in the orientation shown in FIG. 3E, separate support members for each side can be used. More specifically, as one example, the lateral side of support member 420 and the separate medial side of support member 420 shown in FIG. 3C, with their bonding or adhesive material containing sides oriented upward, may be releasably and temporarily fixed to the exposed surfaces 602*a* of pressure plates 602. This releasable and temporary engagement of the support members 420 to the pressure plate surfaces 602*a* may be accomplished in any desired manner, for example, using a light adhesive, electrostatic charge, vacuum attachment, or the like (e.g., any method providing sufficient holding force to hold the support members 420 in position with respect to the pressure plate surface 602*a* during transport (e.g., from Station 1 to Station 2) and/or while the pressure plates 602 move to engage against the sides of upper base member 320). In this manner, because the support members 420 do not extend continuously and wrap around the bottom edge of the upper base member 320 and the jig 100, the heating and pressure applying steps will not produce a crease or fold line on the support member(s) 420. In such constructions, the upper base member 320 may be made from a material (such as a fabric or textile) such that the crease can be removed (e.g., by steaming or ironing) and/or such that the fold line is sufficiently flexible and thin that it does not produce an adverse feel on the bottom of the foot. Also, if the support members 420 extend to locations close to this central line of the bottom edge, the elevation provided by the closely adjacent support members 420 along the central line of the bottom edge may accommodate the crease and negate the feel of the fabric crease (if any) in the bottom of the upper base member 320.

III. Conclusion

The present invention is described above and in the accompanying drawings with reference to a variety of example structures, features, elements, and combinations of structures, features, and elements. The purpose served by the disclosure, however, is to provide examples of the various features and concepts related to the invention, not to limit the scope of the invention. One skilled in the relevant art will recognize that numerous variations and modifications may be made to the embodiments described above without departing from the scope of the present invention, as defined by the appended claims. For example, the various features and concepts described above in conjunction with FIGS. 1A through 3I may be used individually and/or in any combination or subcombination without departing from this invention.

I claim:

1. A sole structure for an article of footwear, comprising:

a foot-supporting surface extending longitudinally along a length of the sole structure and transversely between a medial side and a lateral side of the sole structure;

a ground-facing surface opposite the foot-supporting surface, wherein the ground-facing surface extends longitudinally along the length of the sole structure and transversely between the medial side and the lateral side of the sole structure;

a volume of sole material between the foot-supporting surface and the ground-facing surface to thereby define a thickness profile of the sole structure between the foot-supporting surface and the ground-facing surface; and a plurality of sipes extending from the ground-facing surface into the volume of sole material, wherein at least some of the plurality of sipes form a hexagonal pattern and define a plurality of discrete hexagonally-shaped sole elements at the ground-facing surface, wherein individual hexagonally-shaped sole elements are at least partially defined by one or more sipes of the plurality of sipes, and wherein the plurality of discrete hexagonally-shaped sole elements includes:

(a) a plurality of heel-supporting hexagonally-shaped sole elements defining a first diagonal, a first diagonal dimension D1, a second diagonal, a second diagonal dimension D2, a third diagonal, and a third diagonal dimension D3, and wherein at least two heel-supporting hexagonally-shaped sole elements of the plurality of heel-supporting hexagonally-shaped sole elements include the following properties:

D1=0.8 D2 to 1.2 D2,

D1=0.8 D3 to 1.2 D3, and

D2=0.8 D3 to 1.2 D3, (b) a plurality of arch-supporting hexagonally-shaped sole elements defining a fourth diagonal, a fourth diagonal dimension D4, a fifth diagonal, a fifth diagonal dimension D5, a sixth diagonal, and a sixth diagonal dimension D6, and wherein at least two arch-supporting hexagonally-shaped sole elements of the plurality of arch-supporting hexagonally-shaped sole elements include the following properties:

D4=0.25 D5 to 0.6 D5,

D4=0.25 D6 to 0.6 D6, and

D5=0.8 D6 to 1.2 D6, and (c) a plurality of forefoot-supporting hexagonally-shaped sole elements, defining a seventh diagonal, a seventh diagonal dimension D7, an eighth diagonal, an eighth diagonal dimension D8, a ninth diagonal, and a ninth diagonal dimension D9, and wherein at least two forefoot-supporting hexagonally-shaped sole elements of the plurality of forefoot-supporting hexagonally-shaped sole elements include the following properties:

D7=0.8 D8 to 1.2 D8,

D7=0.8 D9 to 1.2 D9, and

D8=0.8 D9 to 1.2 D9; and wherein in said at least two heel-supporting hexagonally-shaped sole elements, said at least two arch-supporting hexagonally-shaped sole elements, and said at least two forefoot-supporting hexagonally-shaped sole elements, the first diagonal, the fourth diagonal, and the seventh diagonal, respectively, are oriented to extend within 10° of parallel to a transverse direction of the sole structure.

2. The sole structure according to claim 1, wherein said at least two heel-supporting hexagonally-shaped sole elements, said at least two arch-supporting hexagonally-shaped sole elements, and said at least two forefoot-supporting hexagonally-shaped sole elements include the following properties:

D1=0.9 D2 to 1.1 D2,

D1=0.9 D3 to 1.1 D3,

D2=0.9 D3 to 1.1 D3,

D4=0.3 D5 to 0.5 D5,

D4=0.3 D6 to 0.5 D6,

D5=0.9 D6 to 1.1 D6,

D7=0.9 D8 to 1.1 D8,

D7=0.9 D9 to 1.1 D9, and

D8=0.9 D9 to 1.1 D9.

3. The sole structure according to claim 1, wherein said at least two heel-supporting hexagonally-shaped sole elements, said at least two arch-supporting hexagonally-shaped sole elements, and said at least two forefoot-supporting hexagonally-shaped sole elements include the following properties:

D4=0.6 D1 to 1.1 D1,

D4=0.6 D7 to 1.1 D7,

D5=1.5 D2 to 2.5 D2,

D5=1.5 D8 to 2.5 D8,

D6=1.5 D3 to 2.5 D3, and

D5=1.5 D9 to 2.5 D9.

4. The sole structure according to claim 1, wherein in said at least two heel-supporting hexagonally-shaped sole elements, said at least two arch-supporting hexagonally-shaped sole elements, and said at least two forefoot-supporting hexagonally-shaped sole elements, each of D1, D2, D3, D4, D5, D6, D7, D8, and D9 is less than 25 mm.

5. The sole structure according to claim 1, wherein in said at least two heel-supporting hexagonally-shaped sole elements, said at least two arch-supporting hexagonally-shaped sole elements, and said at least two forefoot-supporting hexagonally-shaped sole elements, each of D1, D2, D3, D4, D7, D8, and D9 is less than 10 mm, and wherein each of D5 and D6 is greater than 12 mm.

6. The sole structure according to claim 1, further comprising:

a perimeter wall integrally formed with and extending upward from the foot-supporting surface at least at a rear heel area of the sole structure and forming a rear heel pocket, wherein the perimeter wall defines a free edge extending at least 1 inch in a perimeter direction and at least 0.25 inch in a height direction, and wherein the free edge of the perimeter wall is no more than 0.25 inch thick.

7. An article of footwear, comprising:

an upper at least partially defining a foot-receiving chamber; and the sole structure according to claim 1 engaged with the upper.

8. The sole structure according to claim 1, further comprising:

a perimeter wall of the sole material integrally formed with and extending upward from the foot-supporting surface at least at a rear heel area of the sole structure.

9. The sole structure according to claim 8, wherein the perimeter wall of the sole material defines a rear heel pocket that extends partially over the foot-supporting surface at the rear heel area of the sole structure.

10. The sole structure according to claim 8, wherein the perimeter wall defines a free edge extending at least 1 inch in a perimeter direction and at least 0.25 inch in a height direction, and wherein the free edge of the perimeter wall is no more than 0.25 inch thick.

11. An article of footwear, comprising:

an upper at least partially defining a foot-receiving chamber, wherein the upper further includes an enclosed rear heel portion; and the sole structure according to claim 8 engaged with the upper, wherein at least a portion of the enclosed rear heel portion of the upper is engaged with an interior surface of the perimeter wall.

12. The sole structure according to claim 1, wherein the sole structure constitutes a single, one piece structure made from a polymeric foam material.

13. The sole structure according to claim 1, wherein the sole structure is formed from a polymeric foam material having a density of less than 0.25 g/cm$^3$.

14. The sole structure according to claim 1, wherein the plurality of sipes further includes plural sipes that extend from the arch-supporting hexagonally-shaped sole elements in the transverse direction toward the lateral side of the sole structure and plural sipes that extend from the arch-supporting hexagonally-shaped sole elements in the transverse direction toward the medial side of the sole structure.

15. The sole structure according to claim 1, wherein said at least two arch-supporting hexagonally-shaped sole elements includes at least 8 arch-supporting hexagonally-shaped sole elements having the properties identified for D4, D5, and D6.

16. The sole structure according to claim 15, wherein the sole structure defines a longitudinal length L between a rearmost heel point of the sole structure and a forwardmost toe point of the sole structure, wherein said at least 8 arch-supporting hexagonally-shaped sole elements are located between 0.25L and 0.56L measured forward from the rearmost heel point of the sole structure.

17. The sole structure according to claim 1, wherein said at least two arch-supporting hexagonally-shaped sole elements includes at least 16 arch-supporting hexagonally-shaped sole elements having the properties identified for D4, D5, and D6.

18. The sole structure according to claim 1, wherein the ground-facing surface of the sole structure includes raised ridges integrally formed on the ground-facing surface of the sole structure as a series of enclosed rings.

19. The sole structure according to claim 18, wherein the raised ridges are less than 2 mm high and less than 3 mm wide.

20. The sole structure according to claim 19, wherein the series of enclosed rings are located in a forefoot area of the ground-facing surface.

21. The sole structure according to claim 19, wherein the series of enclosed rings are located in a heel area of the ground-facing surface.

22. The sole structure according to claim 1, wherein each of the plurality of sipes that form the plurality of discrete hexagonally-shaped sole elements has a width of about 1 mm when in an unstressed condition, and wherein the width is defined as a distance between the plurality of hexagonally-shaped sole elements.

23. A sole structure for an article of footwear, comprising:

a foot-supporting surface extending longitudinally along a length of the sole structure and transversely between a medial side and a lateral side of the sole structure;

a ground-facing surface opposite the foot-supporting surface, wherein the ground-facing surface extends longitudinally along the length of the sole structure and transversely between the medial side and the lateral side of the sole structure;

a volume of sole material between the foot-supporting surface and the ground-facing surface to thereby define a thickness profile of the sole structure between the foot-supporting surface and the ground-facing surface; and a plurality of sipes extending from the ground-facing surface into the volume of sole material, wherein at least some of the plurality of sipes form a hexagonal pattern and define a plurality of discrete hexagonally-shaped sole elements at the ground-facing surface, wherein individual hexagonally-shaped sole elements are at least partially defined by one or more sipes of the plurality of sipes, and wherein the plurality of discrete hexagonally-shaped sole elements includes:

(a) a plurality of heel-supporting hexagonally-shaped sole elements defining a first diagonal, a first diagonal dimension D1, a second diagonal, a second diagonal dimension D2, a third diagonal, and a third diagonal dimension D3, and wherein at least two heel-supporting hexagonally-shaped sole elements of the plurality of heel-supporting hexagonally-shaped sole elements include the following properties:

D1=0.8 D2 to 1.2 D2,
D1=0.8 D3 to 1.2 D3, and
D2=0.8 D3 to 1.2 D3, (b) a plurality of arch-supporting hexagonally-shaped sole elements defining a fourth diagonal, a fourth diagonal dimension D4, a fifth diagonal, a fifth diagonal dimension D5, a sixth diagonal, and a sixth diagonal dimension D6, and wherein at least two arch-supporting hexagonally-shaped sole elements of the plurality of arch-supporting hexagonally-shaped sole elements include the following properties:

D4=0.25 D5 to 0.6 D5,
D4=0.25 D6 to 0.6 D6, and
D5=0.8 D6 to 1.2 D6, and (c) a plurality of forefoot-supporting hexagonally-shaped sole elements, defining a seventh diagonal, a seventh diagonal dimension D7, an eighth diagonal, an eighth diagonal dimension D8, a ninth diagonal, and a ninth diagonal dimension D9, and wherein at least two forefoot-supporting hexagonally-shaped sole elements of the plurality of forefoot-supporting hexagonally-shaped sole elements include the following properties:

D7=0.8 D8 to 1.2 D8,
D7=0.8 D9 to 1.2 D9, and
D8=0.8 D9 to 1.2 D9; and a plurality of sipes extending from the foot-supporting surface into the volume of sole material in a forefoot area of the foot-supporting surface.

24. The sole structure according to claim 23, wherein at least some of the plurality of sipes extending from the foot-supporting surface in the forefoot area form a hexagonal pattern, wherein an unsiped thickness of the sole material is provided between and separates the plurality of sipes extending from the ground-facing surface in a forefoot area of the ground-facing surface and the plurality of sipes extending from the foot-supporting surface in the forefoot area of the foot-supporting surface, and wherein at least some portion of the unsiped thickness is at least 4 mm thick.

25. A sole structure for an article of footwear, comprising:

a foot-supporting surface extending longitudinally along a length of the sole structure and transversely between a medial side and a lateral side of the sole structure;

a ground-facing surface opposite the foot-supporting surface, wherein the ground-facing surface extends longitudinally along the length of the sole structure and transversely between the medial side and the lateral side of the sole structure;

a volume of sole material between the foot-supporting surface and the ground-facing surface to thereby define a thickness profile of the sole structure between the foot-supporting surface and the ground-facing surface; and a plurality of sipes extending from the ground-facing surface into the volume of sole material, wherein at least some of the plurality of sipes form a hexagonal pattern and define a plurality of discrete hexagonally-shaped sole elements at the ground-facing surface, wherein individual hexagonally-shaped sole elements are at least partially defined by one or more sipes of the plurality of sipes, and wherein the plurality of discrete hexagonally-shaped sole elements includes:

(a) a plurality of heel-supporting hexagonally-shaped sole elements defining a first diagonal, a first diagonal dimension D1, a second diagonal, a second diagonal dimension D2, a third diagonal, and a third diagonal dimension D3, and wherein at least two heel-supporting hexagonally-shaped sole elements of the plurality of heel-supporting hexagonally-shaped sole elements include the following properties:

D1=0.8 D2 to 1.2 D2,
D1=0.8 D3 to 1.2 D3, and
D2=0.8 D3 to 1.2 D3, (b) a plurality of arch-supporting hexagonally-shaped sole elements defining a fourth diagonal, a fourth diagonal dimension D4, a fifth diagonal, a fifth diagonal dimension D5, a sixth diagonal, and a sixth diagonal dimension D6, and wherein at least two arch-supporting hexagonally-shaped sole elements of the plurality of arch-supporting hexagonally-shaped sole elements include the following properties:

D4=0.25 D5 to 0.6 D5,
D4=0.25 D6 to 0.6 D6, and
D5=0.8 D6 to 1.2 D6, and (c) a plurality of forefoot-supporting hexagonally-shaped sole elements, defining a seventh diagonal, a seventh diagonal dimension D7, an eighth diagonal, an eighth diagonal dimension D8, a ninth diagonal, and a ninth diagonal dimension D9, and wherein at least two forefoot-supporting hexagonally-shaped sole elements of the plurality of forefoot-supporting hexagonally-shaped sole elements include the following properties:

D7=0.8 D8 to 1.2 D8,

D7=0.8 D9 to 1.2 D9, and

D8=0.8 D9 to 1.2 D9; and a plurality of sipes extending from the foot-supporting surface into the volume of sole material in a heel area of the foot-supporting surface.

26. The sole structure according to claim 25, wherein at least some of the plurality of sipes extending from the foot-supporting surface in the heel area form a hexagonal pattern, wherein an unsiped thickness of the sole material is provided between and separates the plurality of sipes extending from the ground-facing surface in a heel area of the ground-facing surface and the plurality of sipes extending from the foot-supporting surface in the heel area of the foot-supporting surface, and wherein at least some portion of the unsiped thickness is at least 12 mm thick.

* * * * *